US006931824B2

(12) United States Patent
Rogers

(10) Patent No.: US 6,931,824 B2
(45) Date of Patent: Aug. 23, 2005

(54) PACKAGING SYSTEM

(75) Inventor: William D. Rogers, Eden Prairie, MN (US)

(73) Assignee: AMEC E&C Services, Inc., Tucker, GA (US)

( * ) Notice: Subject to any disclaimer, the term of this patent is extended or adjusted under 35 U.S.C. 154(b) by 0 days.

(21) Appl. No.: 10/328,142

(22) Filed: Dec. 26, 2002

(65) Prior Publication Data

US 2003/0233812 A1 Dec. 25, 2003

Related U.S. Application Data

(60) Provisional application No. 60/386,581, filed on Jun. 7, 2002.

(51) Int. Cl.[7] ..... B65R 43/42
(52) U.S. Cl. ..... 53/570; 53/389.1
(58) Field of Search ..... 53/168, 284.7, 53/389.1, 570, 571

(56) References Cited

U.S. PATENT DOCUMENTS 1,909,319 A 5/1933 Taylor
2,745,583 A 5/1956 Harker
3,340,679 A * 9/1967 Johnson ..... 53/570
3,667,188 A 6/1972 Benner, Jr. et al.
3,675,389 A 7/1972 Uline
3,691,718 A 9/1972 Woodruff et al.
3,698,153 A 10/1972 Lieberman
3,698,154 A 10/1972 Woodruff et al.
3,708,952 A 1/1973 Schulze et al.
3,813,847 A * 6/1974 Kuhnle ..... 53/570
3,851,751 A 12/1974 Jones
3,894,381 A 7/1975 Christine et al.
3,916,600 A * 11/1975 Falt et al. ..... 53/168
3,948,019 A * 4/1976 Doring et al. ..... 53/570
3,975,888 A 8/1976 Jones (Continued)

*Primary Examiner*—John Sipos
(74) *Attorney, Agent, or Firm*—Leffert Jay & Polglaze, P.A.

(57) ABSTRACT

A method of filling a flexible pouch having a base and sidewalls extending from the base to define a mouth. The method comprising the steps of delivering the pouches an infeed conveyor to a predetermined orientation and transporting the pouches in a controlled manner toward a filler station, and transferring the pouches from the infeed conveyor to a transport conveyor in which the pouch is gripped adjacent to the mouth so as to be suspended from the transport conveyor. Opening the mouth of the pouch to permit filling at the filling station passing the pouches through the filler station, closing the mouth and sealing the mouth prior to release from the transport conveyor.

31 Claims, 24 Drawing Sheets

U.S. PATENT DOCUMENTS

| | | | | | |
|---|---|---|---|---|---|
| 4,027,450 | A | | 6/1977 | Chiu et al. | |
| 4,033,093 | A | * | 7/1977 | Mencacci | 53/571 |
| 4,037,387 | A | * | 7/1977 | Orikawa | 53/571 |
| 4,081,942 | A | | 4/1978 | Johnson | |
| 4,176,741 | A | | 12/1979 | Vogel | |
| 4,246,062 | A | | 1/1981 | Christine | |
| 4,263,768 | A | | 4/1981 | Russell et al. | |
| 4,326,568 | A | | 4/1982 | Burton et al. | |
| 4,330,288 | A | | 5/1982 | Russell et al. | |
| 4,341,522 | A | | 7/1982 | Gaubert | |
| 4,353,198 | A | | 10/1982 | Koppe | |
| 4,418,512 | A | | 12/1983 | Johnson | |
| 4,423,583 | A | | 1/1984 | Carey | |
| 4,509,313 | A | | 4/1985 | Koppe | |
| 4,512,136 | A | | 4/1985 | Christine | |
| 4,580,393 | A | * | 4/1986 | Furukawa | 53/571 |
| 4,718,215 | A | | 1/1988 | Carveth et al. | |
| 4,736,572 | A | | 4/1988 | Fang et al. | |
| 4,956,964 | A | | 9/1990 | Jones et al. | |
| 5,058,364 | A | | 10/1991 | Seiden et al. | |
| 5,304,265 | A | | 4/1994 | Keeler | |
| 5,673,541 | A | | 10/1997 | Arzuman et al. | |
| 5,819,504 | A | | 10/1998 | Giacomelli | |
| 5,862,653 | A | | 1/1999 | Solano | |
| 5,890,350 | A | | 4/1999 | Tisma | |
| 5,983,603 | A | | 11/1999 | Lee et al. | |
| 6,050,061 | A | | 4/2000 | Todd et al. | |
| 6,066,081 | A | | 5/2000 | Bachner | |
| 6,199,601 | B1 | | 3/2001 | Laudenberg | |
| 6,205,746 | B1 | | 3/2001 | Moss et al. | |
| 6,209,708 | B1 | | 4/2001 | Philipp et al. | |
| 6,276,117 | B1 | | 8/2001 | Wiles | |
| 6,378,271 | B1 | | 4/2002 | Skinner et al. | |
| 6,499,280 | B1 | * | 12/2002 | Tsutsui | 53/570 |
| 6,725,635 | B2 | * | 4/2004 | Koppe | 53/570 |

* cited by examiner

PACKAGING SYSTEM

CROSS REFERENCE TO RELATED APPLICATION

This application claims the benefit of U.S. Provisional Patent Application, Ser. No. 60/386,581 filed on Jun. 7, 2002, with the same inventor, William D. Rogers and entitled PACKAGING SYSTEM.

FIELD OF THE INVENTION

The present invention relates to packaging systems and their method of use.

BACKGROUND OF THE INVENTION

There are a wide variety of packaging machines available. The function of most machines is dictated by the container and the product to be packaged in the container. A particular form of container that is becoming more popular is the flexible stand up pouch. The pouches are conocuneous with a peripheral wall extending from a circular or elliptical base to an elongate opening. These pouches are self-supporting but have a degree of flexibility that facilities the packaging of items and the by consumers.

Existing systems utilizing external pouch formers must accumulate pouches and then manually transfer them into a filling and sealing machine. This results in speed, quality, cost, space and operation problems. The pouches are filled through the elongate opening and subsequently sealed. They therefore need to be filled in an upright position, which requires a degree of control to be used on the pouches. Existing systems used to fill such pouches tend to be slow, inefficient and inflexible due to the lack of control exercised on the pouches, their basic design and the drive systems utilized. In particular, where the contents are fluids, the transport of the pouch must be accomplished without spillage or splashes on the top heat seal area.

Prior art in-line machines are intermittent in operation, thereby causing difficulties with fluids in pouches resulting in quality problems such as poor top seals. The intermittent motion of these machines makes it difficult to fill at high speeds (over 200 pouches/minute) for any type of product including solids and liquids of all types. Moreover, fitments are frequently included in the pouch to assist in using and resealing the contents. These fitments must be inserted in a controlled and efficient manner. Existing systems either use a slow three-step manual transfer operation or they operate their filler/sealer at a very slow speed.

Some machines utilize a circular arrangement for filling but this complicates the addition and removal of pouches. Circular machines are also limited in their versatility of products and pouch sizes and are not adaptable to multiple line operations.

In general, existing systems do not seek to maintain control of the product from basic roll stock to the finished shipping unit in a manner that facilitates an integrated production and dispatch of filled pouches.

It is therefore an object to the present invention to obviate or mitigate the above disadvantages.

BRIEF DESCRIPTION OF THE DRAWINGS

An embodiment of the invention will now be described by way of example only with reference to the accompanying drawings in which

Referring therefore to FIG. 1, a container 10, known in the prior art as a flexible stand up pouch, includes a peripheral wall 12 and a base 14. The wall 12 and base 14 are formed from a flexible plastics material with indicia printed on the outside to identify the product within the container. The wall 12 terminates in a mouth 16, which can be sealed after filling to provide an enclosed package. As shown in FIG. 2, additional items referred to as fitments 250, such as spouts or resealable closures, may be incorporated into the wall 12 either during or after initial manufacture of the container 10. The container 10 is of known construction and it will be understood that alternate forms of container may be used with the apparatus and process described below. The pouch 10 is filled using the packaging system 18.

Figure 1:
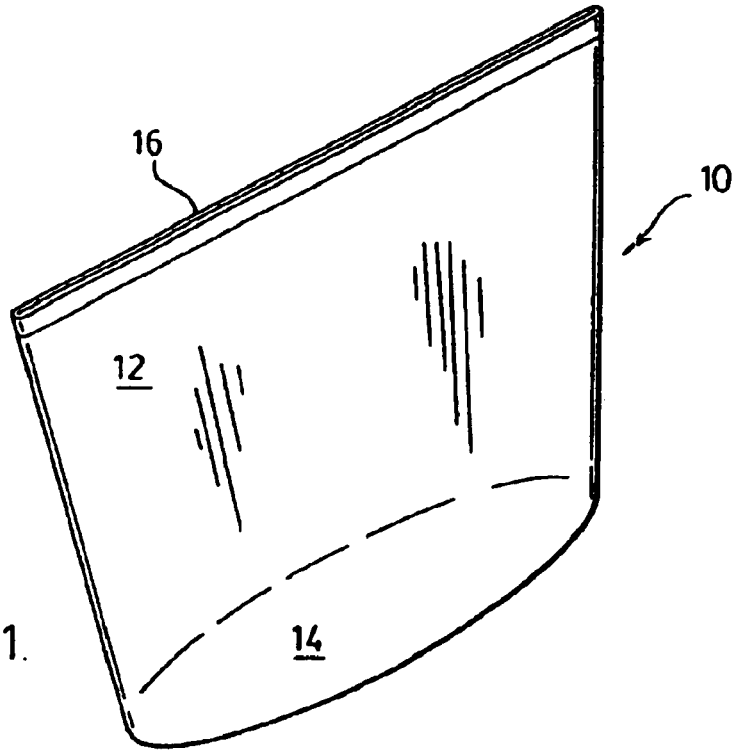
FIG. 1 is a perspective view of a prior art container in the form of a pouch.
Figure 2:
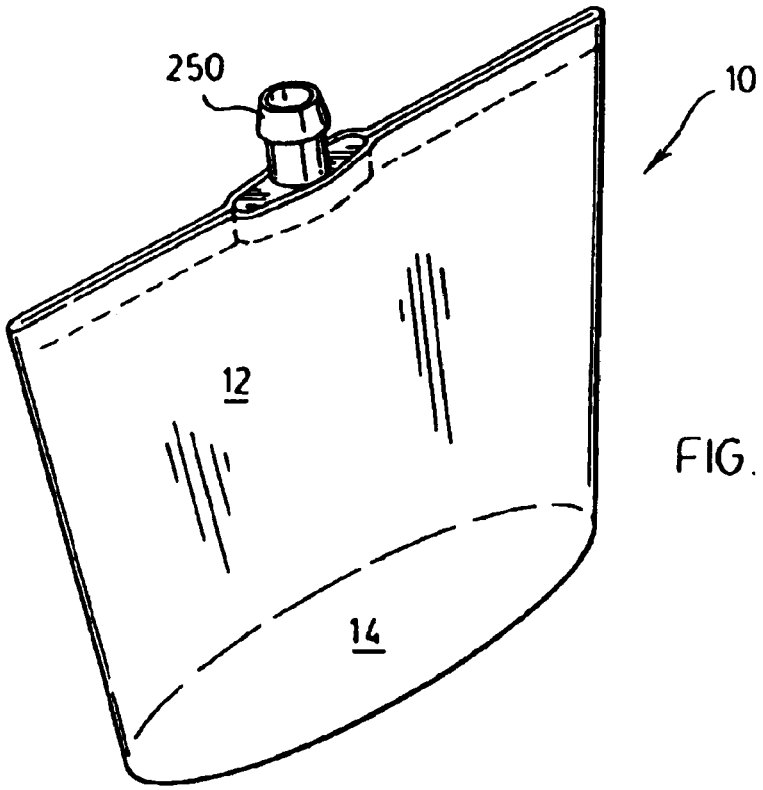
FIG. 2 is a view similar to FIG. 1 of a pouch with a fitment.
Figure 3:
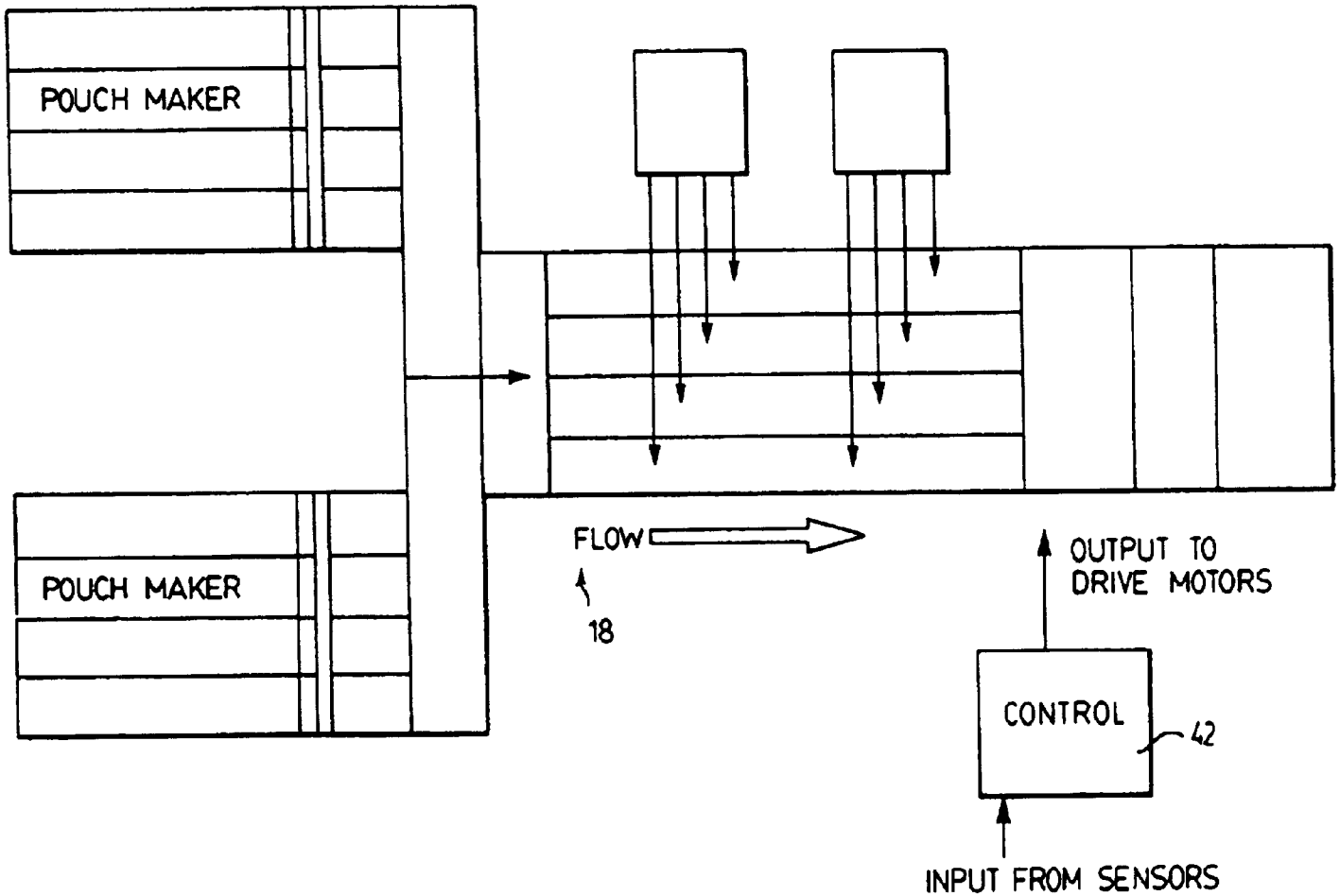
FIG. 3 is a schematic representation of the overall arrangement of a packaging system used to fill the pouches of FIG. 1 and 2.

The general arrangement of the packaging system 18 is shown in FIG. 3 and includes a pair of pouch makers 19, 20 each of which will manufacturer the containers 10 from feedstock in a well-known manner. The containers 10 are manufactured within each of the pouch makers 19, 20 in pairs, two pairs at a time and are delivered four at a time on to discharge conveyors 21, 22. These discharge conveyors 21, 22 deliver the pouches via vision scanning and alignment system 23, 24 to a transfer station 26. Transfer station 26 moves the pouches from either of the discharge conveyors 21, 22 to a filler/sealer in-feed conveyor 28. The filler/sealer in-feed conveyor feeds the pouches 10 from the robotic transfer station 26 through four parallel paths, to the filler/sealer 30, where vacuum swing arms insert the pouches 10 into clips carried on a transport chain of the filler/sealer 30. The filler/sealer 30 moves the pouches along path 31 in 4 lanes through a sequence of pouch opening, filling, fitment insertion, heat-sealing, and seal cooling stations. The filler/sealer 30 is connected to the positive displacement filling system 32 and an optional fitment insertion unit 34, where additional items, such as spouts, may be fitted to the containers 10. After passing through the insertion unit 34, the filled and sealed pouch is passed through a water cooler 36 and in-line inspection and straw feeder station 38 to a cartoning and casing station 40.

It will be appreciated that the combination of units used with a particular container will vary according to the product to be packaged and the manner in which it is packaged. For example, a cooling unit 36 may not be required and a straw feeder 38 will not be required unless the product is a drink product. Control of the movement of the pouches through the system 18 is controlled by a computer-based controller 42 operating through servo actuators on the components of the system. The controller 42 receives control signals from monitors along the path 31 and provides control signals to the motors to maintain the components in synchronism as will be described more fully when the functionality of the system 18 has been explained.

Figure 4:
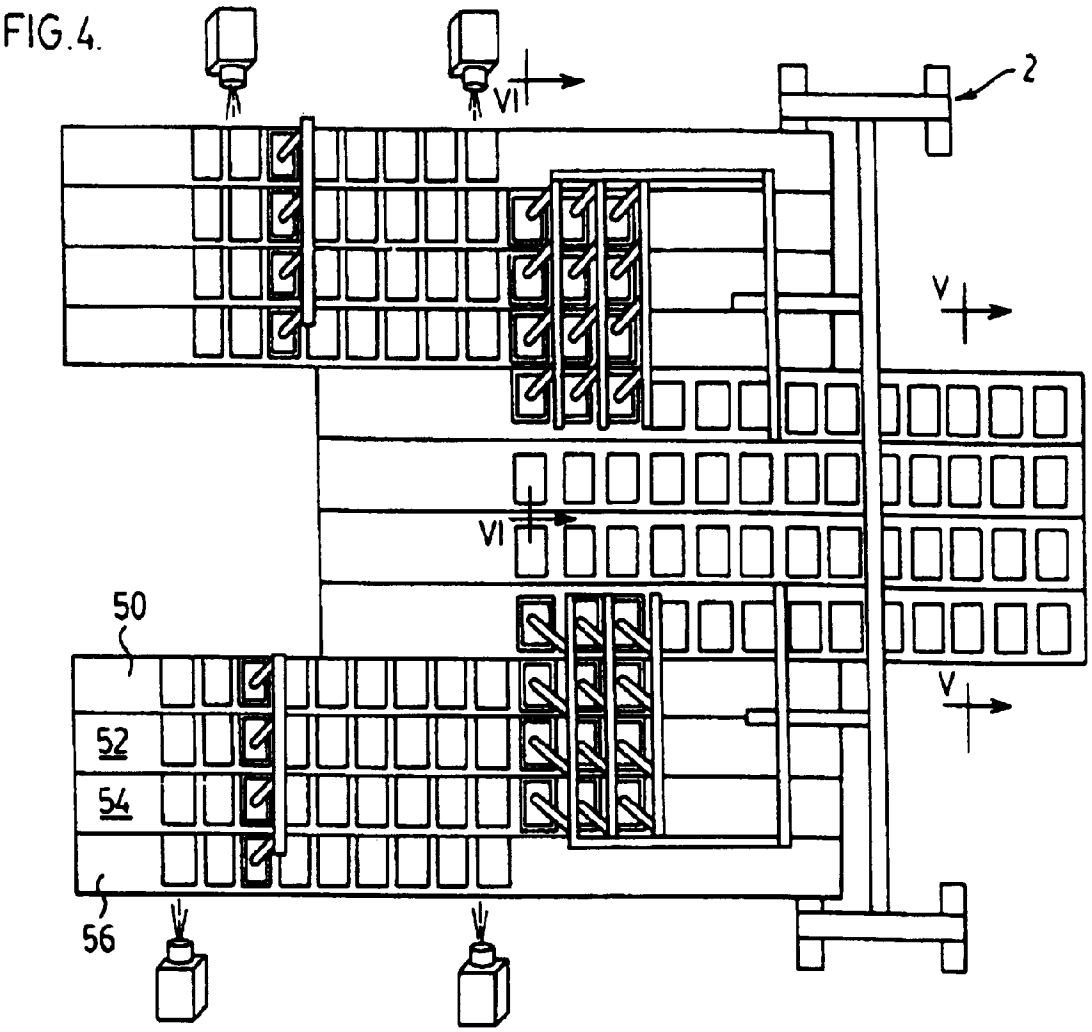
FIG. 4 is a schematic representation of a portion of the machine shown in FIG. 3 in greater detail.

The details of the discharge conveyors 21, 22, vision scanning and alignment systems 23, 24, transfer station 26 and the filler/sealer in-feed conveyor 28 are better shown in FIG. 4. The discharge conveyors 21, 22 include four parallel lanes 50, 52, 54, 56 associated with each of the pouch makers 19, 20. It will be appreciated that each of the pouch makers discharge conveyors and vision scanning and alignment systems is essentially identical and therefore the operation of only one of the pouch makers and associated conveyor and systems will be described in detail. Each of the discharge conveyors 21, 22 are designed to receive the pouches 10 from the pouch makers 19, 20 and pass them through an alignment station having vision scanning and alignment systems 23, 24. The vision scanning and alignment systems 23, 24 ensure the pouches are aligned and placed into the buckets 58 at proper alignment tolerances. The scanning and alignment system 23 includes a camera 25 or laser scanner that determines the position and station of each pouch relative to a preferred orientation. The error is communicated to a robotic arm 27 that adjusts the position of the pouch 10. Typically, a tolerance of ±⅛" along each edge of the pouch is acceptable.

Figure 5:
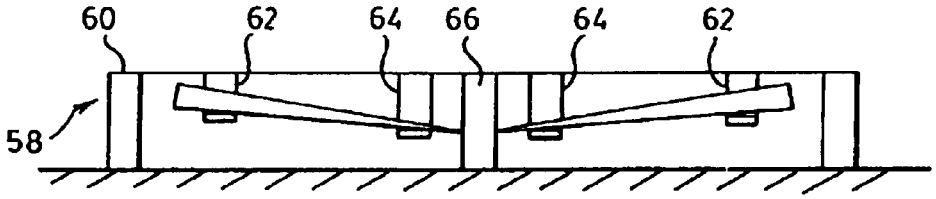
FIG. 5 is a view on the line V—V of FIG. 4.

The bucket 58 is shown in more detail in FIG. 5 and includes a peripheral frame 60. Fingers 62, 64 extend outwardly and downwardly from a pair of opposed sides of the frame 60 to support the pouch 10. The ends of the fingers 64 are arranged to be lower than that of the fingers 62 so that the pouch 10 is supported on an inclined plane and biased into abutment with a central partition 66.

The pouch maker 19, 20 produces the pouches in two pairs that are allochiral so that the mouths 16 are adjacent one another and the bases 14 remote from one another. Accordingly, the frames 60 on opposite sides of the partition 66 are likewise allochiral causing the pouches 10 to abut the common partition 66. The downwardly inclined plane defined by the fingers 62, 64 and the abutment against the partition 66 ensures that the pouches 10 are oriented in a preferred position in each of the buckets 58.

The buckets 58 are advanced along the discharge conveyors 21, 22 as the pouches are produced by the pouch makers 19, 20 to the transfer station 26 which serves as a collection zone to accumulate pouches. Arrival at the transfer station is monitored by a vision system 68 (FIG. 4) that determines that at least 4 rows of filled buckets 58 are accumulated before transfer can be effected.

The vision system 68 also interfaces with the controller 42 to determine which of the discharge conveyors 21, 22 should be accessed by the transfer station 26 to complete the transfer process.

The transfer station 26 includes a robotic device having 2 sets of robotic arms 70 arranged in a 4 by 4 grid and supported by a floor-mounted frame 72. Multiple arms 70 may be arranged in series and larger grids, eg. 4×5, may be utilised to increase the throughput. The multiple axial robotic swing arms 70 are moveable relative to the discharge conveyors 21, 22 in a fore and aft direction as indicated by the arrow X and in a lateral direction as indicated by the arrow Y. The robotic arm assemblies 70 are each individually controllable and have the required movement to be able to move the pouches 10 from the buckets 58 on intermittent motion discharge conveyors 21, 22 to the continuous motion filler/sealer in-feed conveyor 28. As may be seen from FIG. 6, each of the robotic arm assemblies 70 has multiple axial arms 74 that articulated to provide the necessary movement in a horizontal and vertical plane. An actuator 75 is mounted on the swing arm 74 and may extend vertically toward and away from the buckets 58. Each of the actuators has a head 76 that carries a suction pad that is engagable with the pouch 10 to secure it to the arm assembly for transfer.

Figure 6:
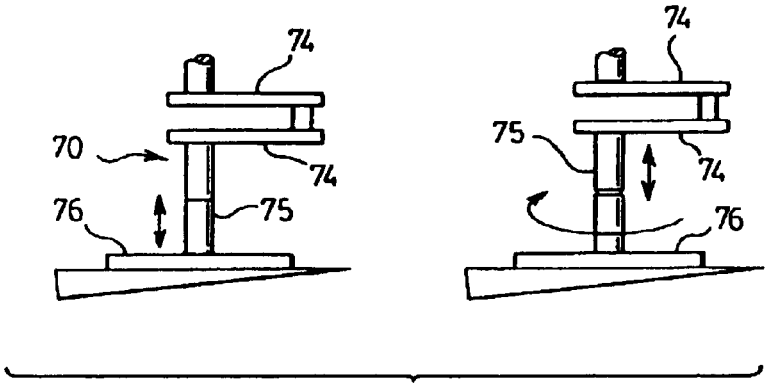
FIG. 6 is a view on the line VI—VI of FIG. 4.

The arm assembly 70 also provides for rotation of the head 76 about a vertical axis. As illustrated in FIG. 6, the height of the head 76 may be individually adjusted by the actuator 75 so that after picking up the pouches 10 they may be staggered in a vertical direction during transfer. A pair of the heads 76 in each row of four are then rotated through 180° to move the pouches into an orientation with both pair of pouches having their mouths facing away from the centre for depositing into buckets 80 on the conveyor 28.

Figure 7:
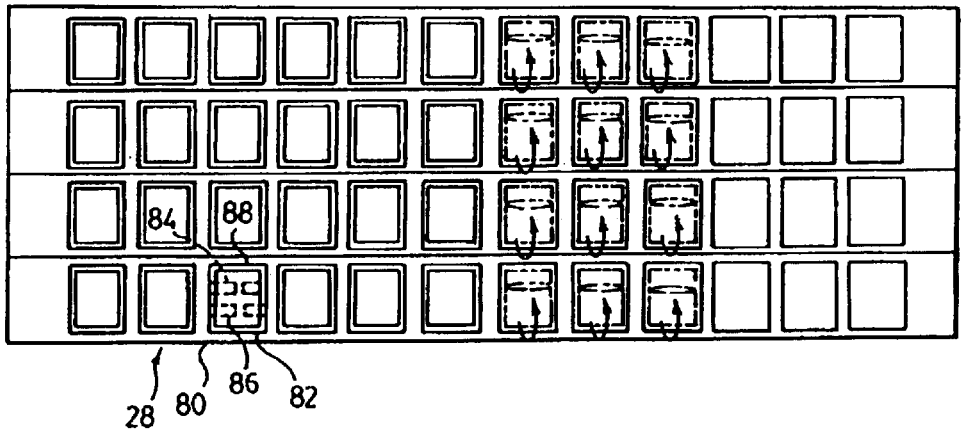
FIG. 7 is a plan view of a conveyor using the machine shown in FIG. 3.
Figure 8:
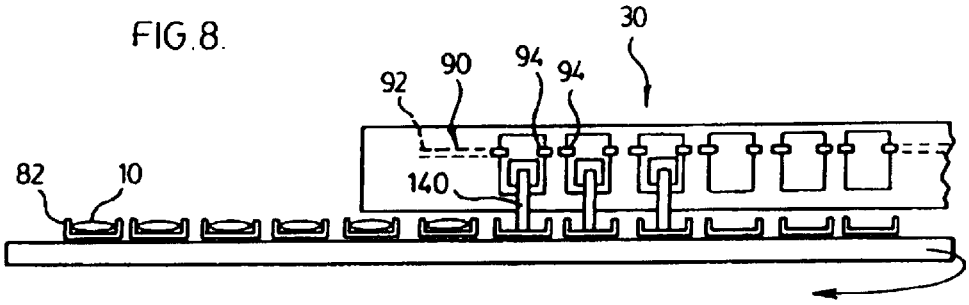
FIG. 8 is a side elevation of the conveyor shown in FIG. 7.

The filler/sealer in-feed conveyor 28 is also arranged in four lanes with a set of containers in the form of buckets 80 arranged along the lanes. The buckets 80 can be seen in FIGS. 7 and 8 and include an open frame 82 supporting fingers 84,86 to maintain the pouches 10 in a predetermined orientation. The fingers 84, 86 are arranged in a similar manner to the fingers 62, 64 so that the pouch 10 is biased toward the end wall 88 of the respective frame 82.

The buckets 80 are advanced on the filler/sealer in-feed conveyor 28 in a controlled continuous manner by servomotors controlled by the controller 42. The buckets 80 are advanced to the filler/sealer 30 shown schematically in FIGS. 10 and 11. It will be appreciated that each lane is similar and therefore only one will be described in detail. Similar operations are undertaken in parallel in the other lanes as the pouches advance.

The fill filling/sealing unit 30 has a number of different stations arranged sequentially along path 31. The pouches 10 are advanced in continuous motion and are dressed in sets of 3 through each station. Movement of the pouches through the filler/sealer 30 sealing units is controlled by a transport conveyor 90. The transport conveyor 90 includes a drive chain 92 that carries clip assemblies 94 and is driven in a continuous manner by a servomotor, not shown, under the control of controller 42. The clip assemblies 94 are arranged in pairs and maintained at a nominal spacing corresponding to the spacing between the buckets 80 on the conveyor 28 and act as retainers to grip the pouch.

Figure 13:
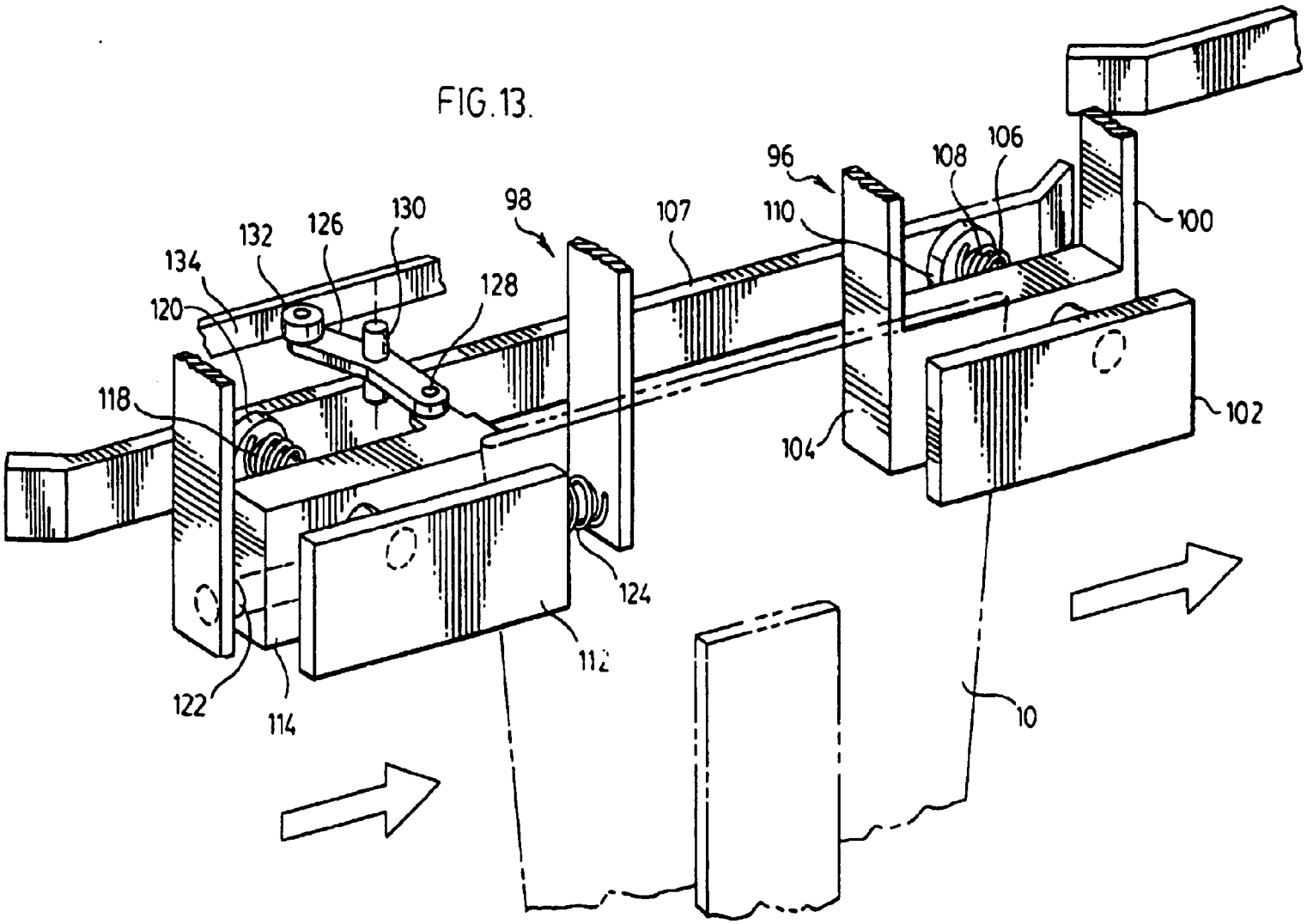
FIG. 13 is a perspective view of the mechanism used to perform the successive steps of FIG. 12.
Figure 14:
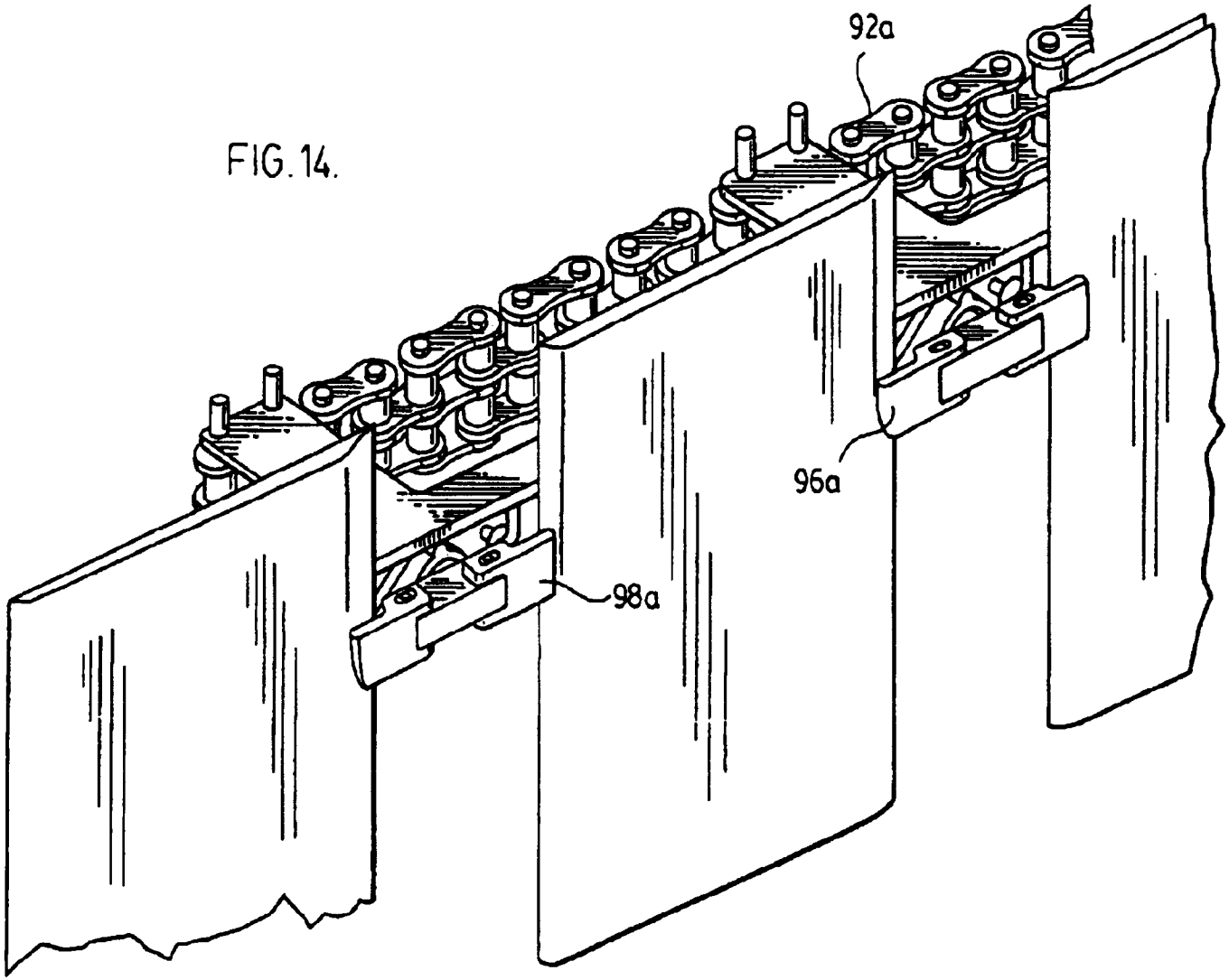
FIG. 14 is a perspective view similar to FIG. 13 of an alternative embodiment.
Figure 15:
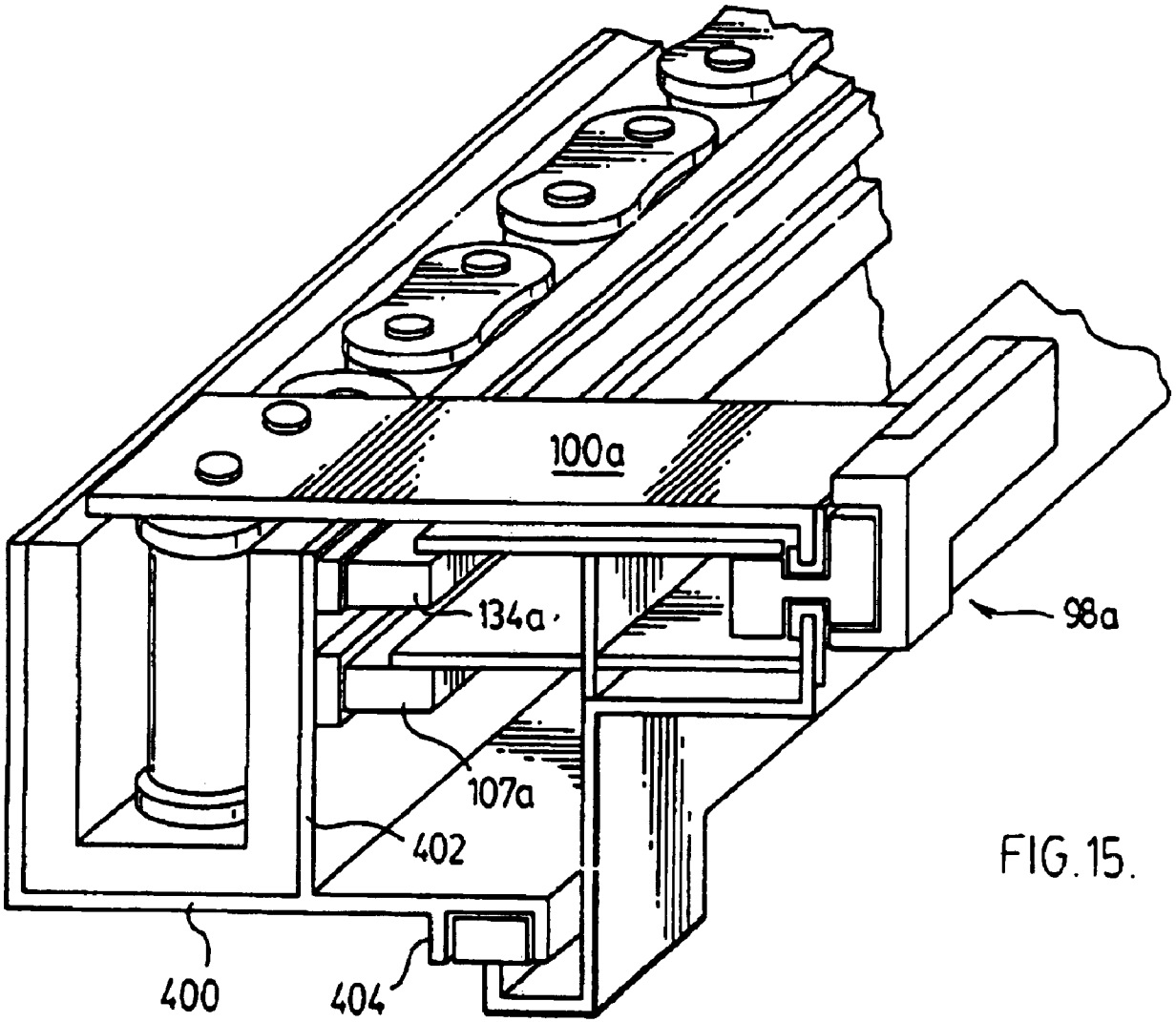
FIG. 15 is a perspective end view of the alternative embodiment of the apparatus shown in FIG. 14.
Figure 16:
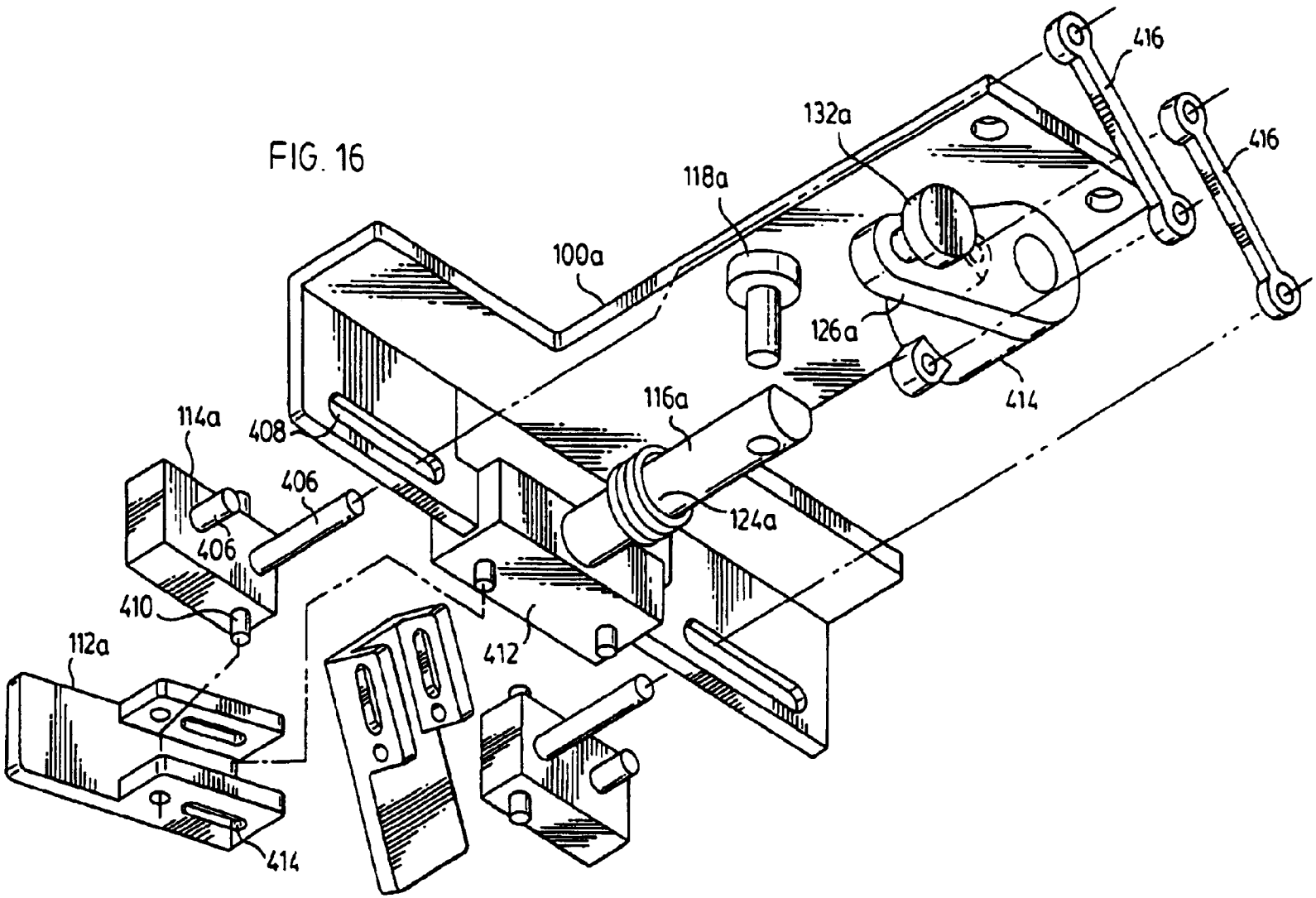
FIG. 16 is an exploded perspective view of a clip shown in FIG. 14.
Figure 17:
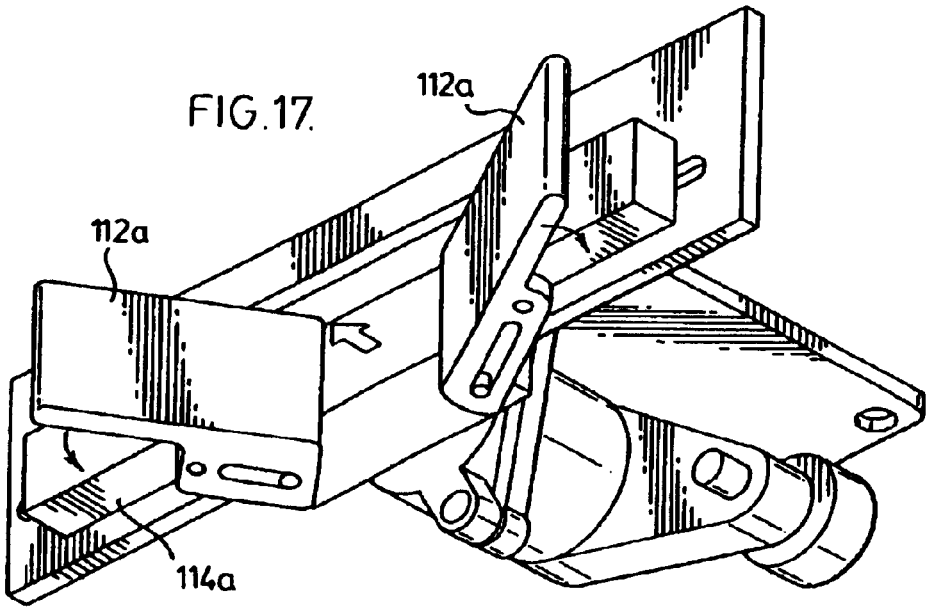
FIG. 17 is a perspective view from beneath the clip of FIG. 15.
Figure 18:
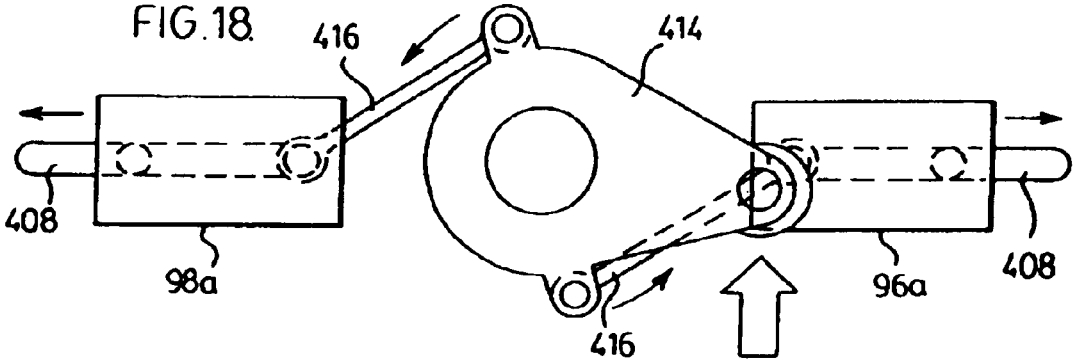
FIG. 18 is a rear view showing the operation of the clip of FIG. 15.
Figure 19:
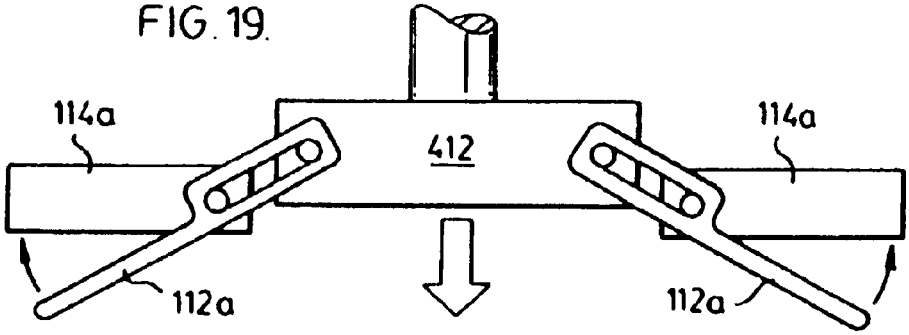
FIG. 19 is a plan view of the clip shown in FIG. 15.

One embodiment of the clip assemblies 94 is shown in FIG. 13 and includes a stationary clip 96 and a sliding clip 98. Each of the clips 96, 98 is supported by hangers 100 depending from the chain 92.

The clip 96 has a pair of jaws 102, 104. The jaw 104 is attached to the hangers 100 and the jaw 102 is moveable in a direction transverse to the movement of the chain 92 between open and closed positions. The jaw 102 is secured to the jaw 104 by a pin 106 that is slidably received in the jaw 104 and biased to a closed position by a spring 108. The pin 106 has a head 110 that can be engaged by actuating cam 107 at selected positions to overcome the bias of the spring 108 as will be explained below.

The clip 98 is similar to the clip 96 having a pair of jaws 112, 114. The jaw 112 is guided for movement between open and closed positions by a pin 116. A spring 118 biases the jaws 112, 114 to a closed position and a head 120 is provided for co-operation with an actuator to open the jaws. The jaws 112, 114 are moveable as a unit longitudinally relative to the hangers 100. To accomplish this jaw 114 is slidably mounted on a rod 122 and biased away from the clip 96 by a spring 124. Movement of the jaw 114 along the rod 122 is controlled by a cam follower 126 connected to the jaw 114 at a pin 128. The cam follower 126 has a fulcrum 130 supported on the chain 92 and a cam lobe 132 for engagement with a set of cam bars 134 disposed through the filler/sealer 30 as will be described in more detail below. Engagement of the follower 126 with the cam bar 134 effects longitudinal movement on the rod 122 and thereby moves the clip 98 in the direction of movement of chain 92 toward the clip 96.

Figure 9:
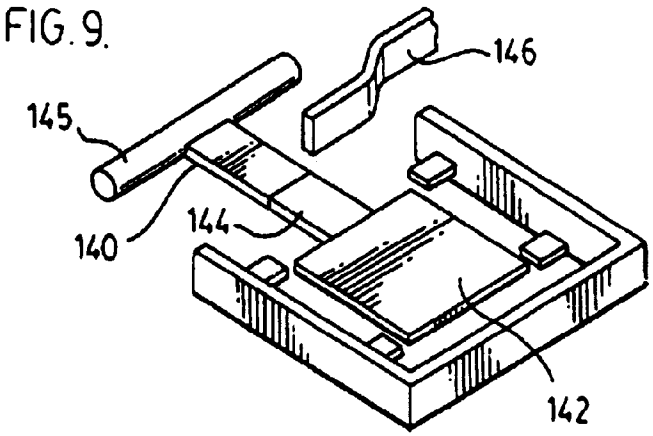
FIG. 9 is a perspective view on an enlarged scale of a component used in the conveyor shown in FIG. 7 and 8.
Figure 10:
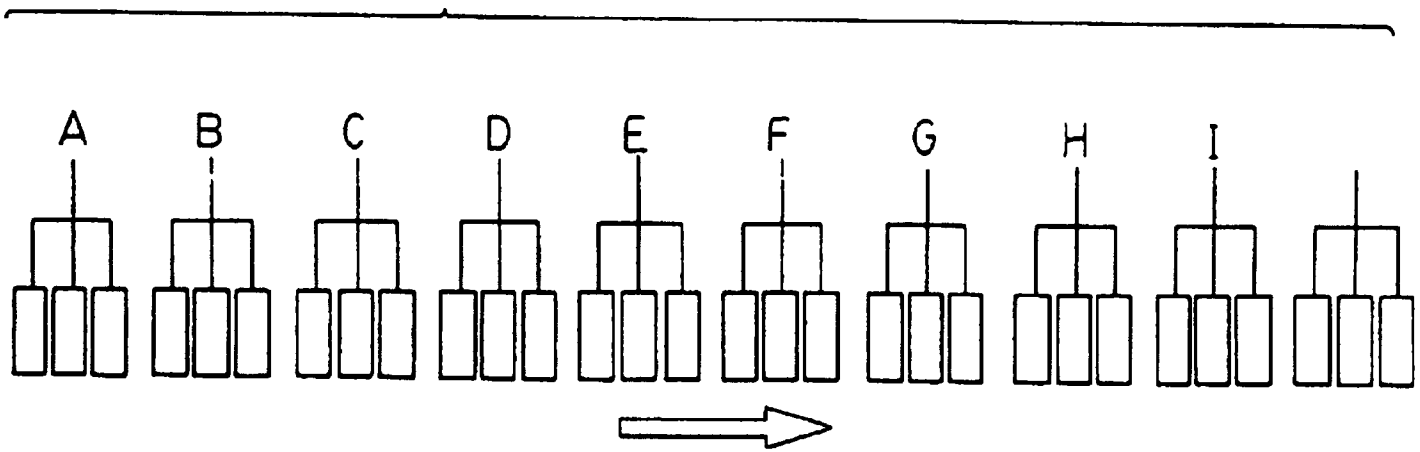
FIG. 10 is a representation of the progress of the pouches of FIG. 1 through the filling station on the machine of FIG. 3.
Figures 11, 12:
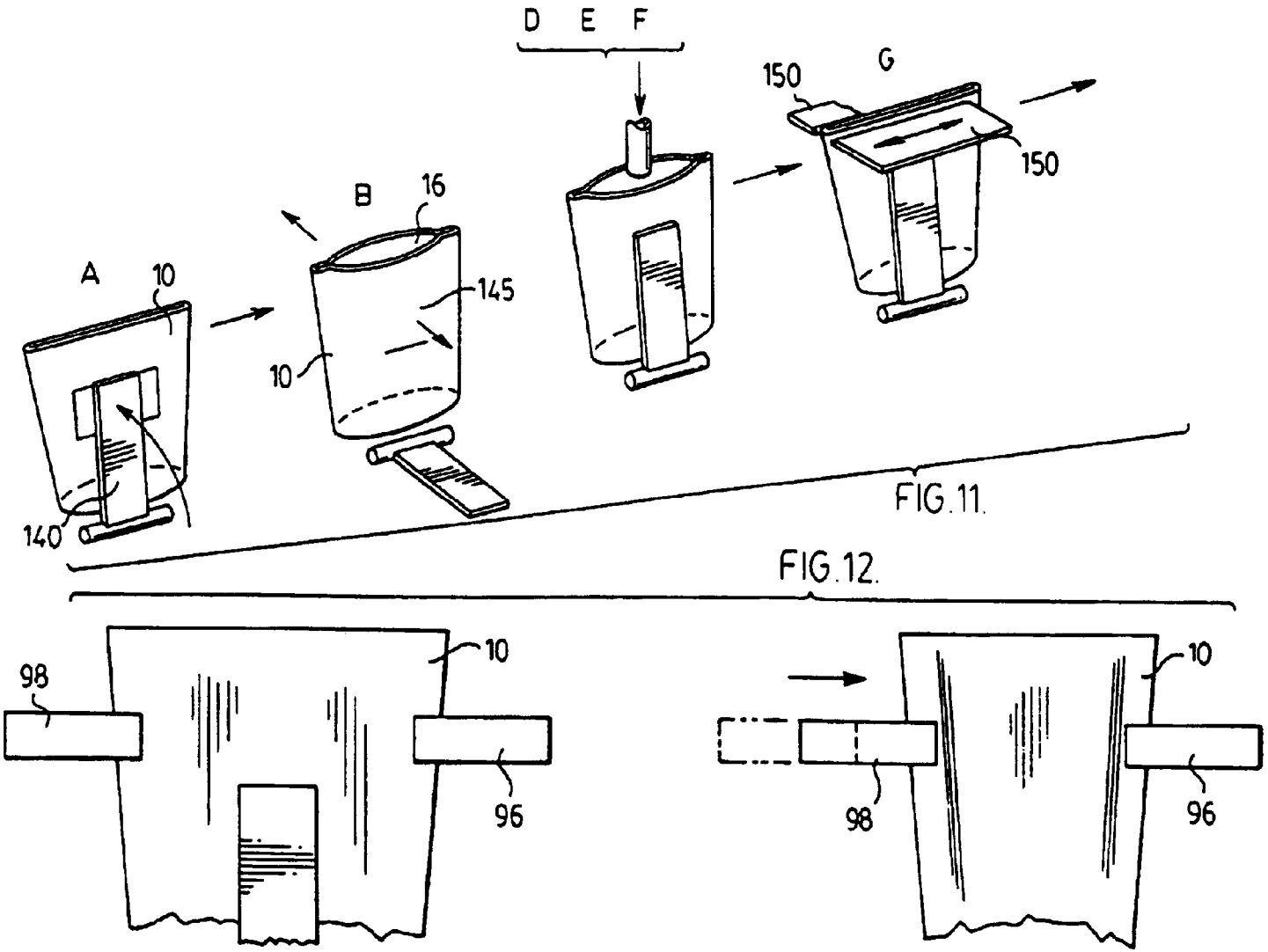
FIG. 11 is a schematic representation in greater detail of the passage of a pouch through apparatus shown in FIG. 10.
FIG. 12 is a side elevation showing in greater detail the successive steps in opening the pouch in FIG. 11

The passage of the pouch through the filler/sealer 30 is shown in greater detail in FIGS. 10 to 12. Transfer of the pouches 10 from the buckets 80 to the clip assemblies 94 is accomplished by swing arm 140 associated with each of the buckets 80 as part of the filler/sealer in-feed conveyor 28. These swing arms elevate the pouches 10 from a horizontal position to a vertical position and place the pouches 10 into the filler/sealer 30's chain clips 96,98 shown in FIG. 12 and 13, at filler sealer 30 station A. As can best be seen in FIG. 9 the swing arms 140 include a vacuum pad 142 secured to one end of a telescopic arm 144 and selectively connected to a vacuum source as it moves with the conveyor 28. For example, the shaft 145 may be ported to a vacuum manifold so that as it rotates, the pad 142 is connected to the manifold and the pouch subjected to the suction. The arm 144 is mounted upon a shaft 145 rotatable about a horizontal axis so that it may move from a horizontal to a vertical position. Movement of the arms 144 is controlled by a stationary cam located under the arms 144 in the filler/sealer in-feed conveyor as the buckets 80 arrive under station A of filler sealer 30. The continuous motion in-feed conveyor 28 and the continuous motion filler/sealer carrier chain must be aligned and moving at the same speed to allow for the pouch transfer from the discharge conveyor buckets 80 to the carrier chain clips 94. The action is accomplished by controller 42 synchronizing the linear servo motor drives of each conveyor and ensuring proper alignment.

Cam bar 107 associated with each of the clips 96, 98, is configured at the station A so that the heads 110, 120 are automatically actuated by the movement of the conveyor chain 90 to overcome the bias of the springs 108, 118 and open the clips 96, 98. After the arm 140 has been moved to a vertical position, the arm 144 is extended to move the edges of the pouch 10 between the jaws 102–104, 112–114 of the clips 96, 98 respectively as shown in chain dot lines in FIG. 13. The cam bar 107 is profiled to release the heads 110, 120 and allow the jaws 102, 104, 112, 114 to move to a closed position and grip the pouch 10 at its edges as the chain advances. Once the jaws are closed, the vacuum is released from the pad 142 and the arms 140 retracted and returned to the horizontal position below the buckets 80.

With the arms retracted, the filler/sealer in-feed conveyor 28 returns buckets 80 and associated arms 140 to the transfer station and chain 92 carries the pouches 10 to the second station within the filling/sealing unit 30. As the chain 92 is advanced to the second station B, the cam lobe 132 engages with the cam bar 134 and slides the jaw 114 along the rod 122. At the same time the oppositely directed flanks of the pouch 10 are engaged by suction cups 145 (FIG. 11) causing the mouth 16 of the pouch 10 to open to present an unencumbered interior of the pouch 10.

The cam bar 134 extends to the next station, station C, and so holds the mouth of the pouch 10 open. At this station, an air blast is provided to inflate the pouch 10 to ensure that the walls are separated.

Movement of the sets of pouches 10 continues through a set of fill stations D, E, and F, each of which may be used to add an additional component to the pouch 10 or to supplement the contents already in the pouch 10. In the next station G fitments are added if required. During movements through these stations, the cam bar 134 engages the lobe 132 to maintain the clips 96, 98 toward one another and ensure the mouth 16 remains open. The cam bar 134 terminates at the end of the fitment insertion station G, and the springs 124 slide the jaws 112, 114 along the rod 122 return the clips 96, 98 to their original spaced position. The increase in the spacing of the clips 96, 98 cause the mouth 16 to close ready for scaling.

Before describing the subsequent stages of fitment insertion and sealing, an alternative embodiment of clip to that shown in FIG. 13 will be described with reference to FIGS. 14 through 19 in which like references will be used to identify like components with the suffix a added for clarity. In the embodiment shown in FIGS. 14 to 19 the clips 96*a*, 98*a* are integrated into a single unit and each is movable relative to the chain 92*a* to effect opening of the pouch 10*a*. As can be seen from FIG. 15, the chain 92*a* is supported in a housing 400. A wall 402 of the housing 400 carries the cam bars 134*a*. A hanger 100*a* projects laterally from the chain

92*a* and provides support for the movable components of the clip 98*a*. The hanger 100*a* extends downwardly to engage in a channel 404 located on the underside of the housing 400. The channel provides stability for the clip 98*a* when loaded by the pouch 10*a*.

As can best be seen in FIGS. 16 through 19, the clip 98*a* includes a pair of jaws 112*a*, 114*a*. The jaws 114*a* have a pair of pins 406 that slide in slots 408 provided in the front face of hanger 100*a*. The jaw 112*a* is pivotally connected to jaw 114*a* by a pin 410 and is connected to an enlarged head 412 of actuating rod 116*a*. The connection of the jaw 112*a* to the head 412 is through a pin and a slot 414.

The rod 116*a* carries a roller 118*a* at its inner end for engagement with the cam tracks 107*a* and is slidably supported for movement transverse to the direction of movement of the chain 92*a* in a housing 414. The housing 414 is rotatably supported on the hanger 100*a* and has an actuating arm 126*a* that carries a roller 132*a* for engagement with the cam bars 134*a*. The housing 414 is connected to the pins 406 of jaws 114*a* by a pair of links 416 pivotally connected to the pins 406 and the housing 414. A torsion spring 124*a* is located within the housing to bias the housing 414 to the position shown in FIG. 18.

In operation, with the rod 118*a* retracted, the jaws 114*a*, 112*a* are open and the pins 406 are at one limit of travel in the slots 408 to move the jaws 114*a* toward one another. Upon engagement of the roller 118*a* with the cam track 134*a*, the rod 116*a* is extended relative to the hanger 100*a* to cause pivotal movement of the jaw 112*a* toward the jaws 114*a*. The jaws 112*a*, 114*a* close about the edges of the pouch 10, which is then gripped between the jaws.

Upon engagement of the roller 132*a* with the cam track 134*a*, the housing 414 is rotated relative to the hanger 100*a* causing the pins 406 to slide along slots 408 and move the jaws 112*a*, 114*a* toward the centre line of the pouch 10*a*. A similar movement is effected at the opposite edge of pouch 10*a* causing the mouth to open as described above.

The cam bars 134*a* are profiled to achieve the same motion as described above with respect to the embodiments of FIG. 13 and therefore do not need to be described further. It will be noted that the arrangements of FIGS. 14 through 19 provide close coupling between the pouches 10 and a unitary construction for pairs of clips to provide enhanced compactness of the design.

Figure 20:
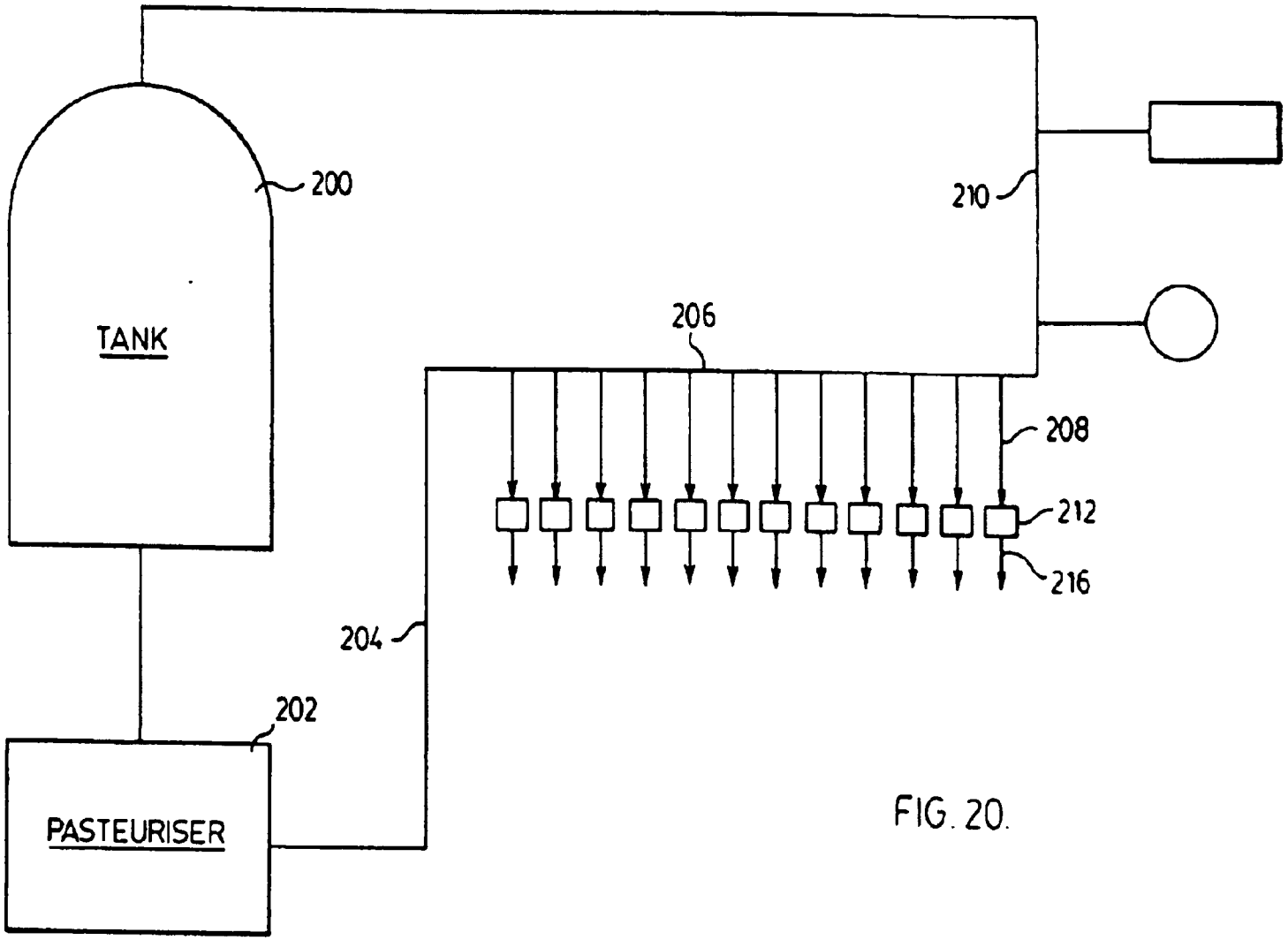
FIG. 20 is a schematic representation of a filler circuit.

Returning to the processing of the pouch 10 through the system, where the contents of the pouch 10 are a fluid, the supply of fluid to the pouches 10 at stations D E and F is preferably supplied through a closed loop system shown in FIG. 20. The fluid is stored in a batch holding tank 200 and delivered upon demand to a high temperature short time pasteuriser 202. The pasteuriser supplies fluid at the requisite temperature through an outlet 204 to a header 206. The header 206 delivers fluid under positive pressure to each of a number of conduits 208, one for each pouch in which fluid is to be disposed, and returns surplus fluid through overflow line 210 to the tank 200. The conduits 208 have a flexible wall to allow for pinch-seal intake and discharge valving.

Figure 21:
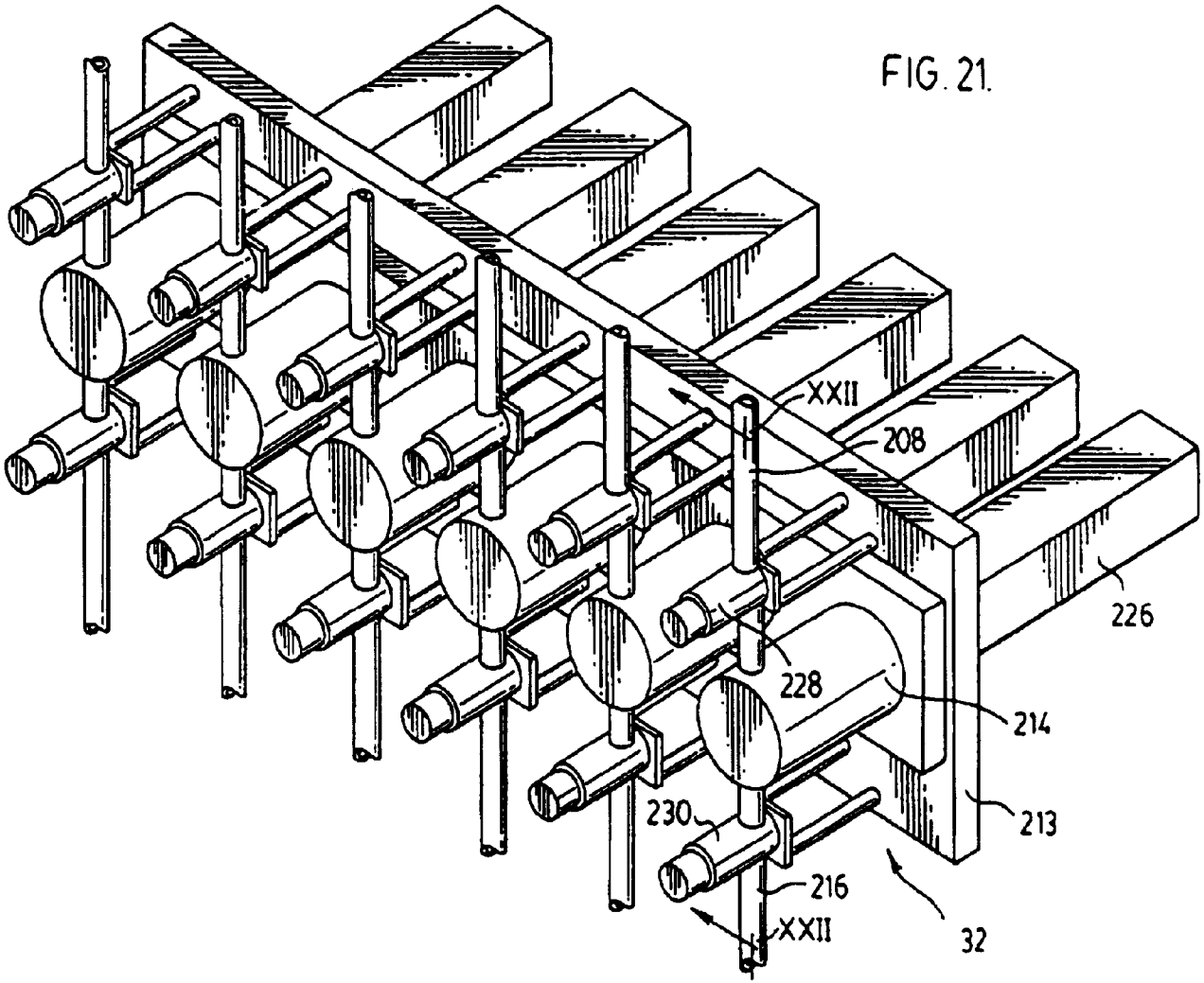
FIG. 21 is a front perspective view of a pump assembly used in the circuit of FIG. 20.
Figure 22:
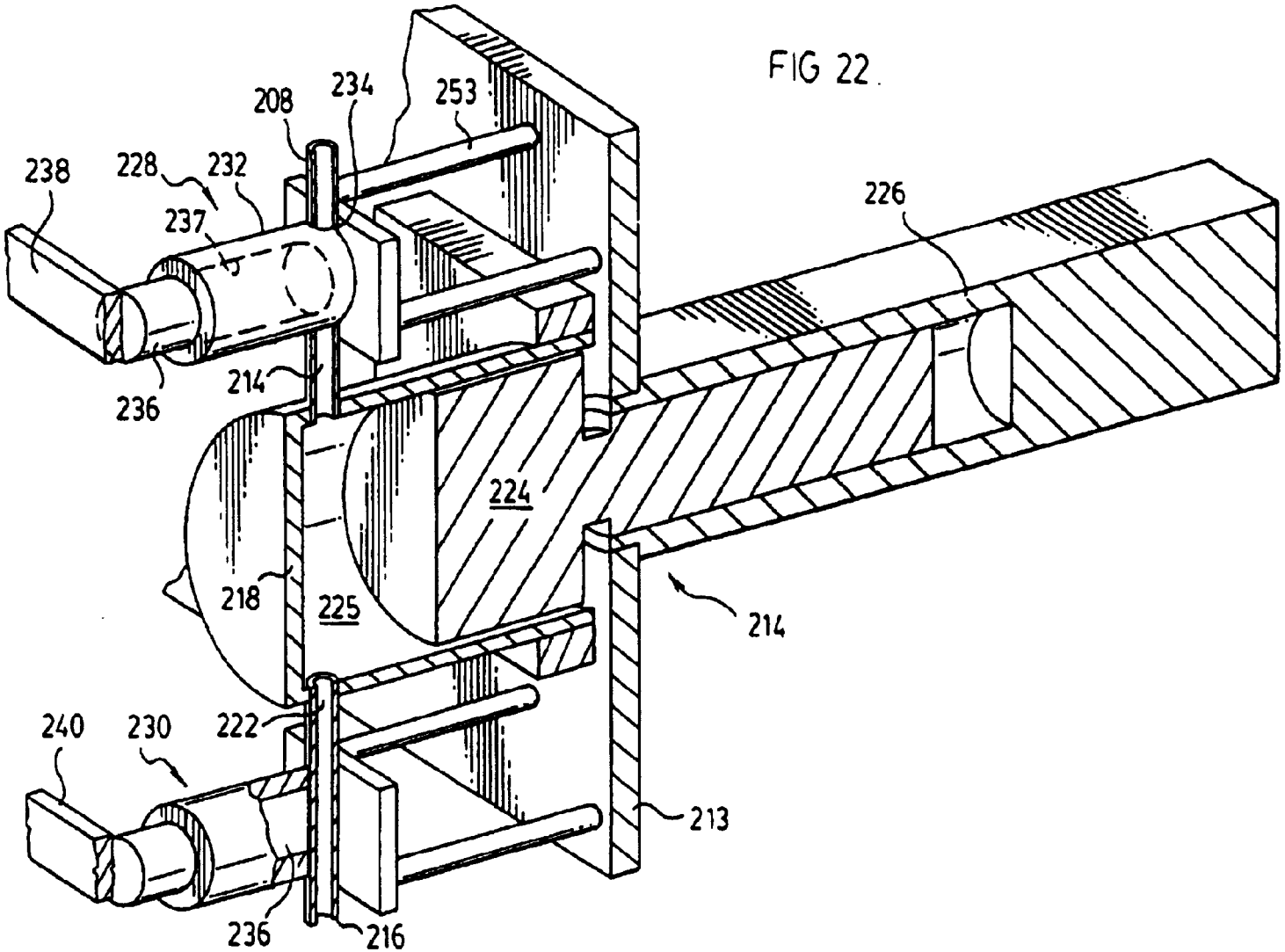
FIG. 22 is a section on the line XXII—XXII of FIG. 21.

Control of fluid through each of the conduits 208 is provided by the positive displacement filler pump assembly 212 shown in FIGS. 21, and 22. The pump assembly 32 is mounted on a support plate 213 which in turn is fixed to the framework of the filler/sealer unit 30. Each of the filler pump assembly 32 includes a pump 214 to transfer fluid from the conduit 208 to a supply line 216 that is attached to a filling nozzle that is disposed in the mouth of a respective pouch 10. The supply line 216 is flexible so the filling nozzles can follow the movement of the pouch 10 on the conveyor 92 as it is filled and subsequently be returned to an initial position. Movement is effected by a linear actuator controlled by said controller 42. The pump 214 includes a cylinder 218 having an inlet port 220 and an outlet port 222. A piston 224 defines a chamber 225 within the cylinder 218 and reciprocates under the control of a linear servomotor 226. The servomotor 226 under the control of the controller 42 drives the piston 224 in proportion to the line speed and the volume to be dispensed to vary the fill rate of pouch 10.

Flow through the ports 220, 222 is controlled by a pair of valves 228, 230 that operate on the conduit 208 and supply line 216 respectively. Each of the valves 228, 230 has a body 232, which is supported on the plate 213 by pins 233. The body 232 has a bore 234 through which the conduit 208 or supply line 216 passes. A plunger 236 is mounted in a slide 238 formed in the body 232 to intersect the bore 234. The head of the plunger engages the wall of the conduit 208 or supply line 216 and the opposite end is engaged by actuating plates 238, 240 respectively. The plates 238, 240 are controlled by synchronism with the servo motor 226 to open and close valves 228, 230 and induce fluid in to the chamber 225 from the conduit 208 as the chamber expands and expel fluid from the chamber 225 to supply line 216 as it contracts. Reciprocation of the piston 224 continues until the required volume of fluid is dispensed, at which time the mouth of the pouch 10 is closed.

After the filling at station F is complete the pouches move to station G. As noted above, the profile of the cam 134 at the end of station G allows the cam follower 126 to pivot about its fulcrum 130 and move the clip 98 away from the clip 96. The spacing between the clips 96, 98 thus increases, causing the mouth of the pouch to close. A preliminary top seal is applied by heated sealing plates 150 applied to the pouch adjacent the mouth 16. The plates 150 move with the pouch 10 and contact the walls 12 long enough to effect a seal but not to melt the pouch. After the requisite time, the plates 150 are released and returned to a start of the station G to engage the next set of pouches 10. The closure of the mouth 16 provides containment of the contents of the pouch 10 so that on subsequent movement of the pouches 10 to the next station the contents are less likely to spill. If fitments are to be used they are inserted at the beginning of station G as will be explained more fully below.

Figure 23:
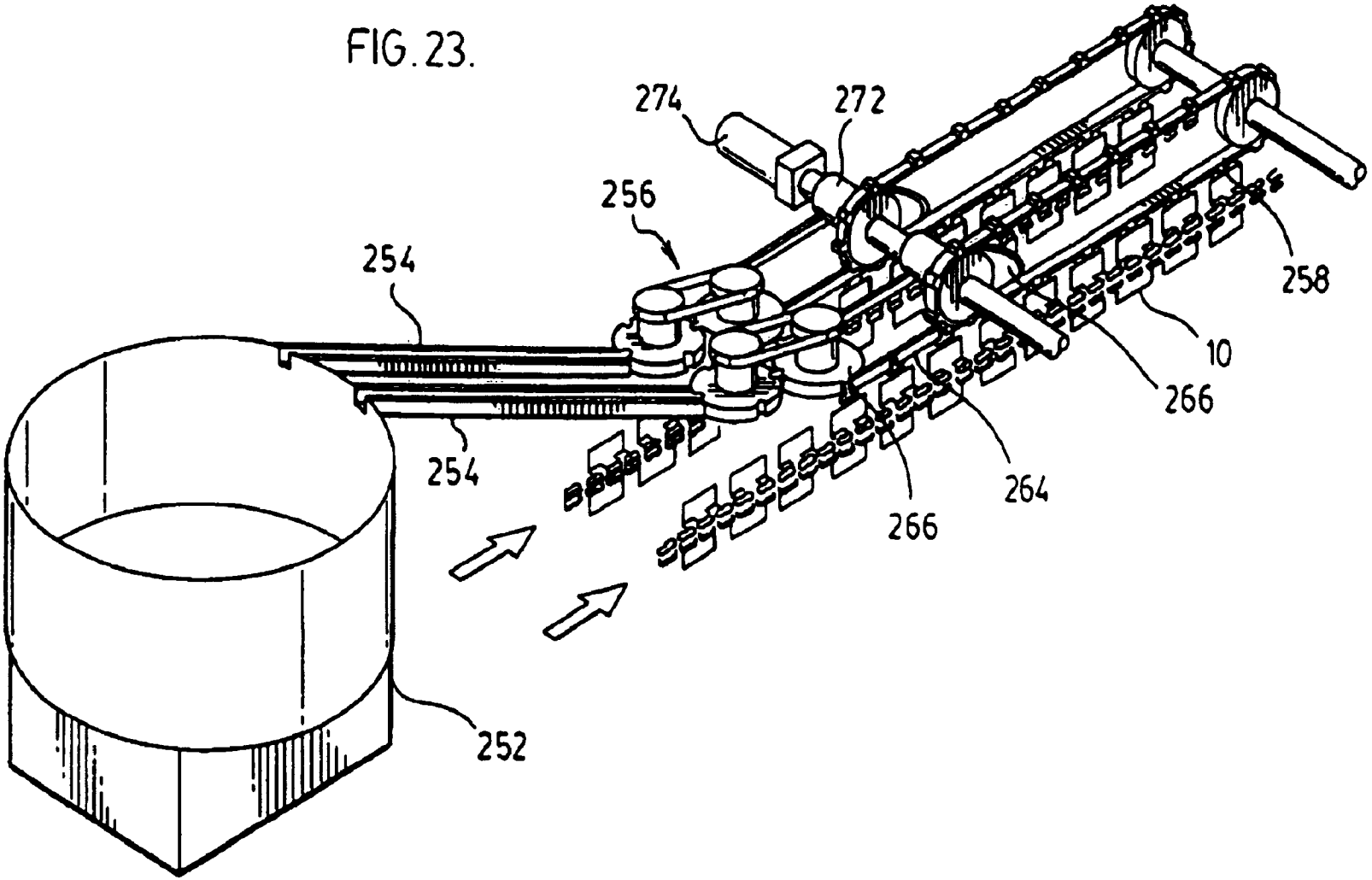
FIG. 23 is a perspective view of a fitment placing stage that may be incorporated in the packaging system of FIG. 2.
Figure 24:
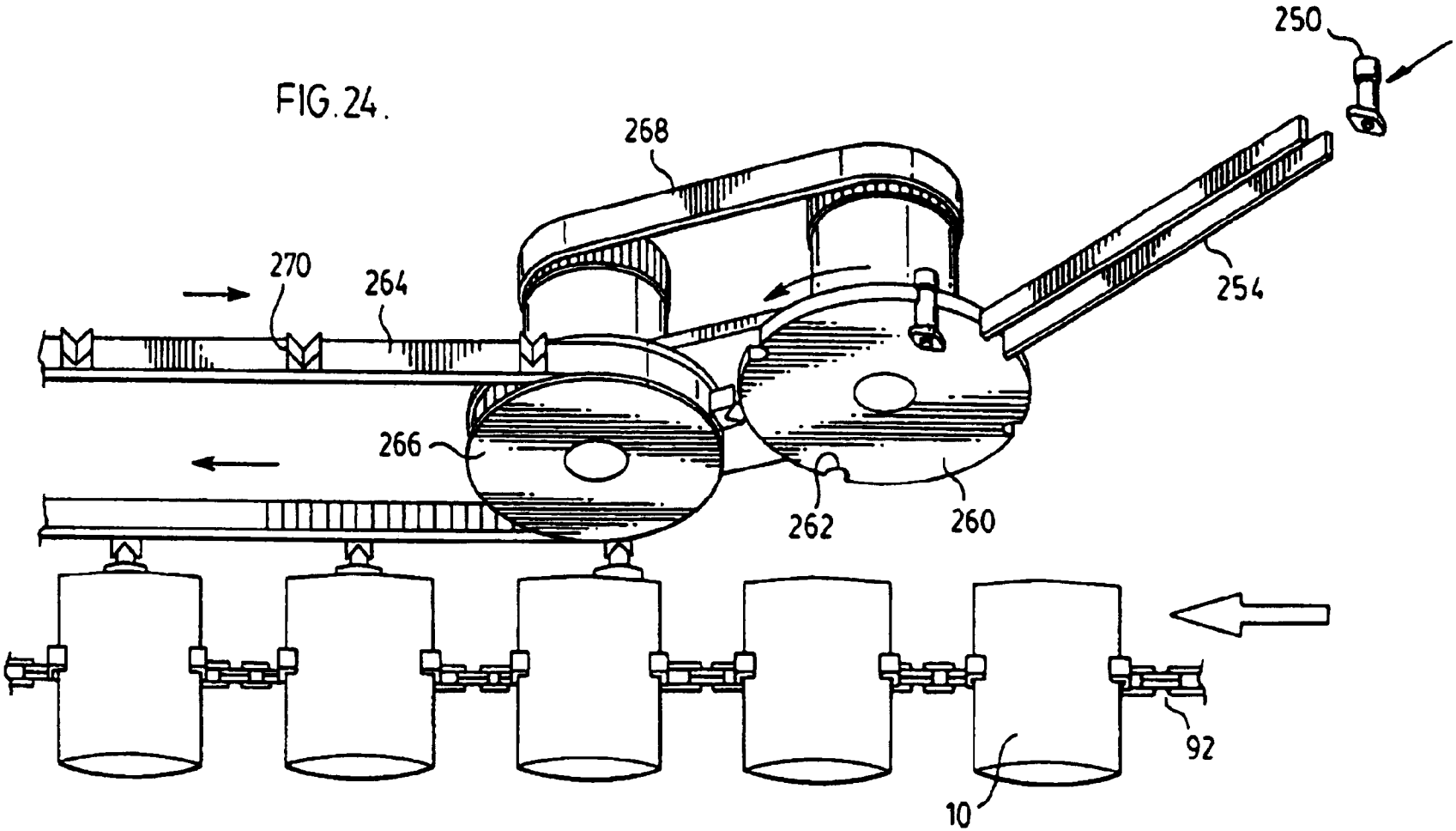
FIG. 24 is a side view of a portion of the device shown in FIG. 23.
Figure 25:
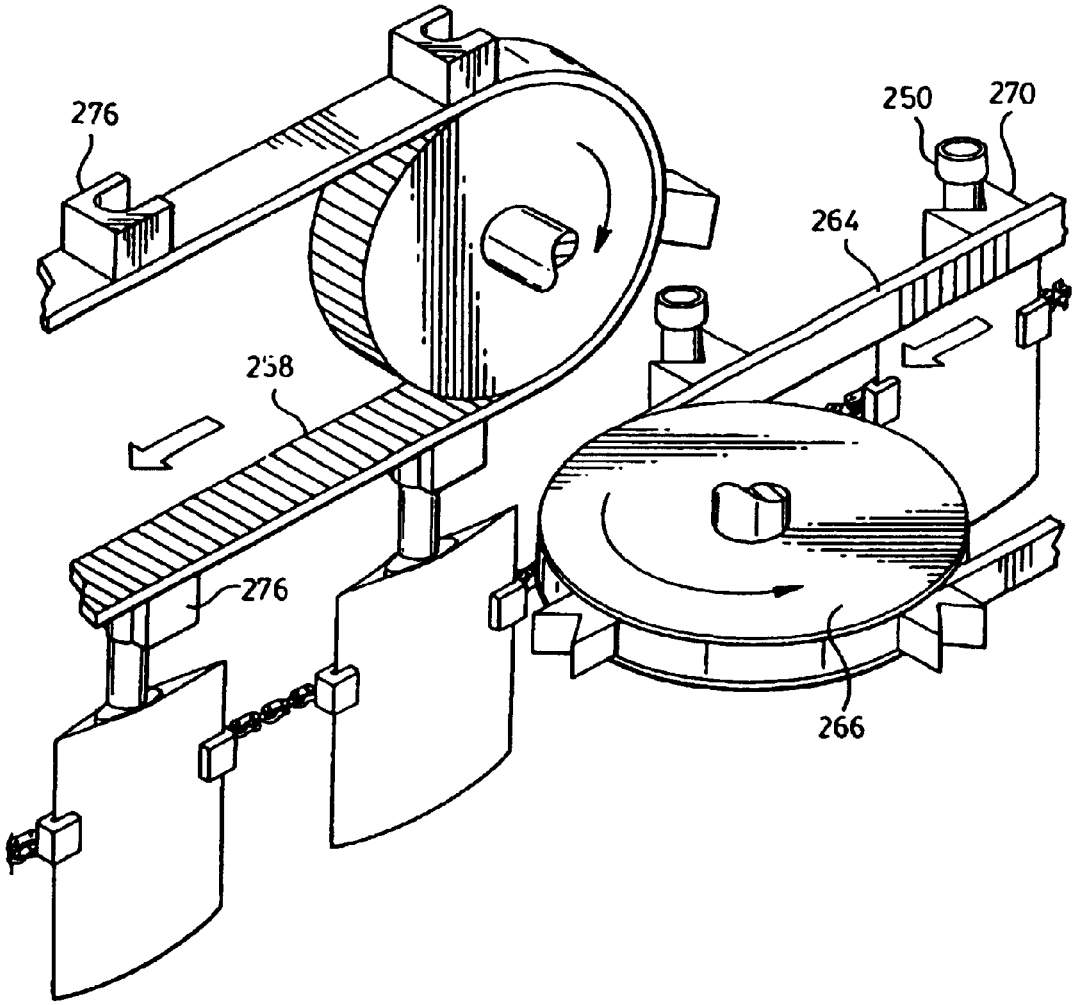
FIG. 25 is a perspective view of the fitment placing stage shown in FIG. 24.

With the plates 150 retracted and a tack seal applied, the chain 92 moves the set of pouches 10 to the next station H, where final top seal is made at the mouth 16 of the container 10 in a manner similar to that at station G. At the next station I the top seals are cooled by a cooling plates. Where a fitment is used, the plates 150 will be profiled to accommodate the fitment and ensure a seal around it The insertion of a fitment 250 into the pouch shown in FIGS. 22 through 25 and operates in conjunction with the movement of the pouches through the station G. As shown in FIG. 23 through 25, the fitment 250 is applied to the four lanes of pouches 10 in parallel with the fitment 250 being fed from a pair of vibrator hoppers 252. (Only one hopper is shown in FIG. 23 but it will be understood that a duplicate arrangement is utilised to feed the other pair of lanes.) The hoppers 252 deliver the fitment through slides 254 to a transfer mechanism 256. The transfer mechanism 256 includes an inclined belt 264 convergent with the transport conveyor 90 and delivers the fitment 250 into the mouth of pouch 10 and then transfers the fitment to horizontal placement belt 258 positioned above the mouth of the pouches 10. The placement belt 258 travels in unison and parallel with the pouches 10 holding the fitments 250 in the mouth of the pouch and releases them as the spacing between the clips 96, 98 increases and the preliminary tack seal is applied causing the mouth of the pouch 10 to close and hold the fitment 250.

The inclined transfer mechanism 256 includes a notched wheel 260 that rotates about a vertical axis adjacent the end of a respective slide 254. The periphery of the wheel 260 has a series of notches 262 and as the notches pass the end of the slide 254 they receive a fitment 250 that is carried by the wheel to inclined belt 264. The belt 264 is entrained about a pair of toothed pullies 266 that are maintained in synchronism with the wheel 260 by a timing belt 268. The belt 264 has a carrier 270 on its outwardly directed surface that is configured to engage the fitment 250 in the notch 262 as the carrier 270 passes the periphery of the wheel 260. The fitment 250 is thus transferred from the notch 262 to the carrier 270 and delivered by the inclined belt 264 and is progressively introduced into the mouth of the pouch and then transferred to the placement belt 258. The belt 258 is aligned with the run of chain 92 so that the fitments 250 are held in place in to the mouth of the pouch 10.

The placement belt 258 is also a toothed belt driven in synchronism with the belt 266 through a gearbox 272 and motor 274. The placement belt 258 has carriers 276, similar to the carriers 270, and configured to support the fitment along a lower horizontal run of the belt 258. As can best be seen in FIG. 25, the carrier 276 provides continued support for the fitment 250 as the pouches are moved through the station and the clips 96, 98 spaced to close the mouth of the pouch around the fitment. A sealer (not shown) is then applied to the mouth of the pouch to secure the fitment and the carrier 276 releases the fitment and pouch for further processing.

The pouches then move through successive stations to provide a final top seal, cooling of the pouch 10 and integrity check.

As the pouch 10 moves through station J, the pouch 10 is transferred from the conveyor 90 to a supplementary chain conveyor 171 as shown in FIGS. 26 to 29,. A top clip 172 carried by the supplementary conveyor chain 171 is opened by a cam 173 acting against cam follower 294. The clips 172 are positioned over the pouches by conveyor chain 171. As the cam-follower 294 clears the cam 173 and the clips 172 grab the top edge of the pouch 10 and support it. At the same time cam 107 engages the head 110, 120 of the clips 96, 98 to open the clips and release the sides of the pouches. As the pouch 10 is released, it is moved laterally to clear the clips 96, 98 and allow further transportation of the pouch. The filled and sealed pouch is then passed through the cooler 36, inline pressure testing & straw feeder 38 if included to the cartooning and casing station where it can be packaged according to customer's requirements.

Figure 27:
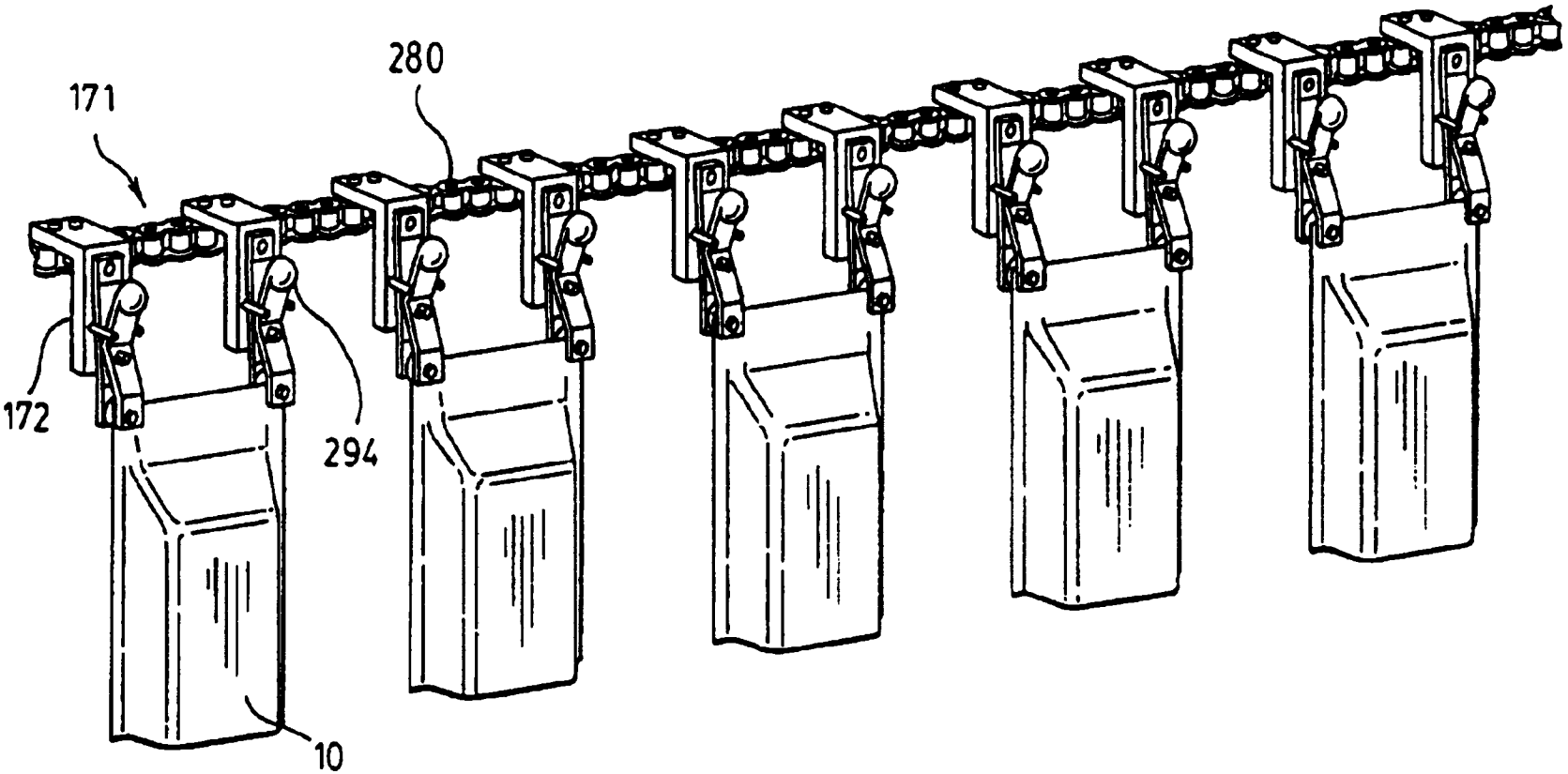
FIG. 27 is a perspective view of a portion of the cooler/dryer transport chain used in the pouch transfer and cooler in-feed station of FIG. 26.
Figure 28:
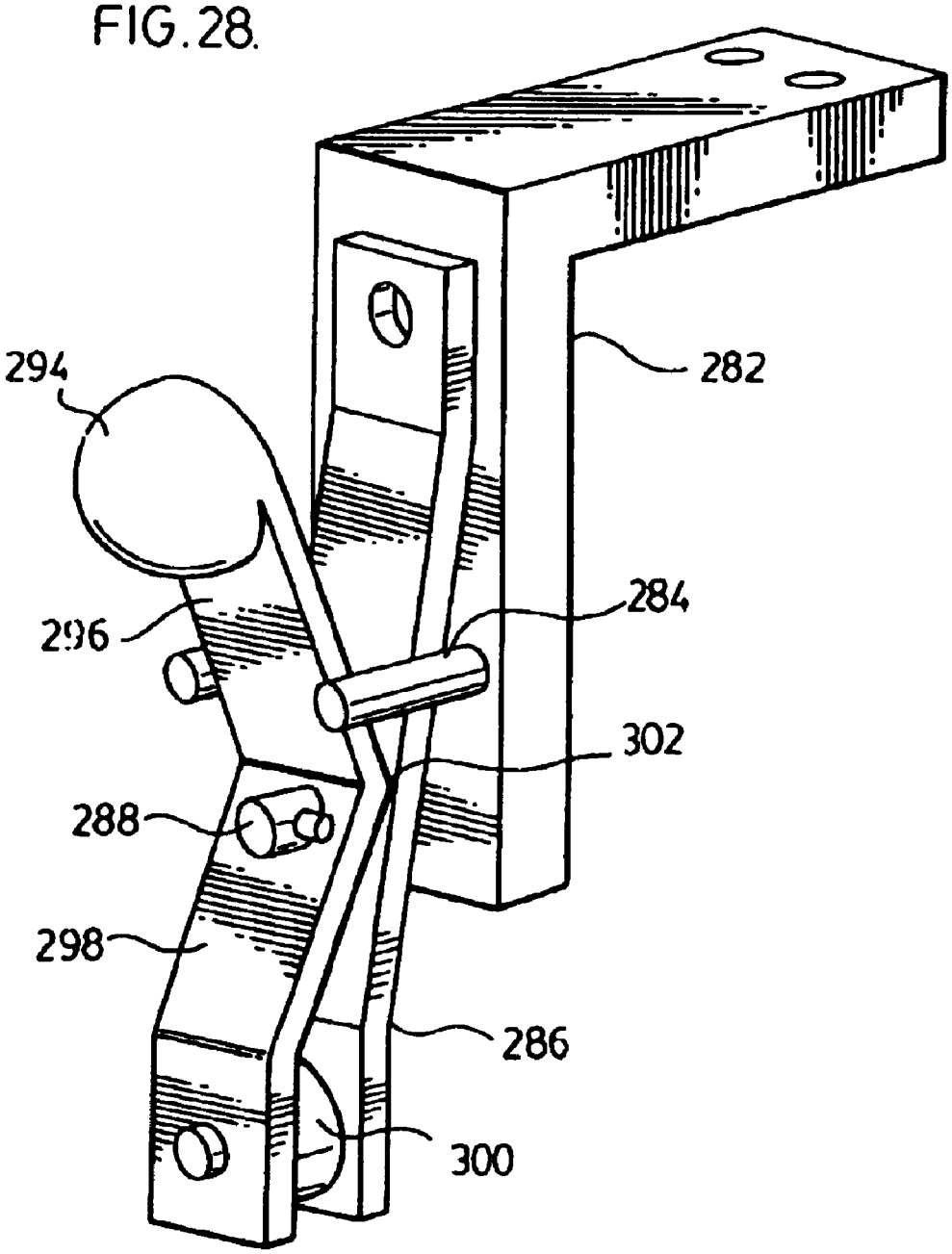
FIG. 28 is a perspective view of a clip used on the conveyor of FIG. 27.
Figure 29:
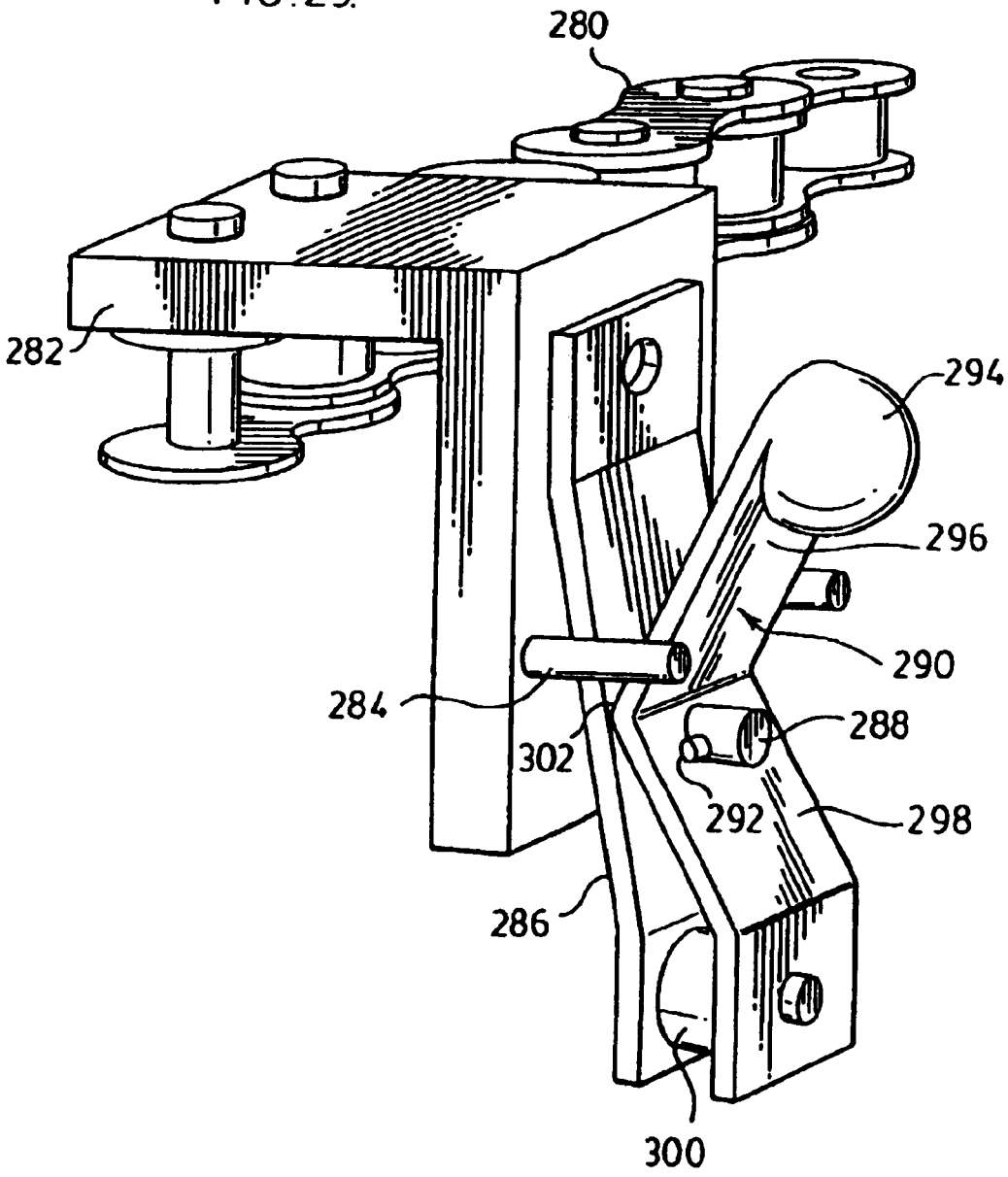
FIG. 29 shows the conveyor chain connection to the clips of FIG. 28.

As can be seen from FIGS. 27, 28 and 29, the top clip 172 depends from a chain 280 on an L-shaped bracket 282. The bracket 282 has a pair of guide pins 284 extending to opposite sides of as resilient jaw 286. The jaw 286 is secured to the bracket 282 and is jogged along its length so that its lower end is spaced from the body of the bracket 282. The jaw 286 has a circular aperture that passes over a retaining pin 288 secured to the body of the bracket 282. A rigid cranked jaw 290 is also received on the retainer pin 288 and secured by a fulcrum pin 292.

The rigid jaw 290 is generally V-shaped having a pair of arms 296, 298 extending from the right. A head 294 is provided at the distal end of one of the arms 296. The other arm 298 terminates in a gripping pad 300 that is disposed generally parallel to the distal end of the flexible jaw 286.

The resilience of the flexible jaw 286 forces the fixed jaw 290 against the fulcrum pin 292 causing it to rotate about the fulcrum pin and bring the pad 300 into engagement with the lower end of the resilient jaw 286. The jaws 286, 290 may be separated upon application of a force to the head 294 to rotate the jaw 290 in the opposite direction about the fulcrum pin 290 and cause flexure of the jaw 286. The flexure is induced by the heel 302 formed opposite the fulcrum pin 292 in the bight of the V-shaped jaw 290. The head 294 is as positioned against a cam surface 173 in FIG. 26 as it is lowered into position over the pouch 10 and released by the cam surface 173 to engage the pouches and support them as they released by the clips 96, 98.

Figure 26:
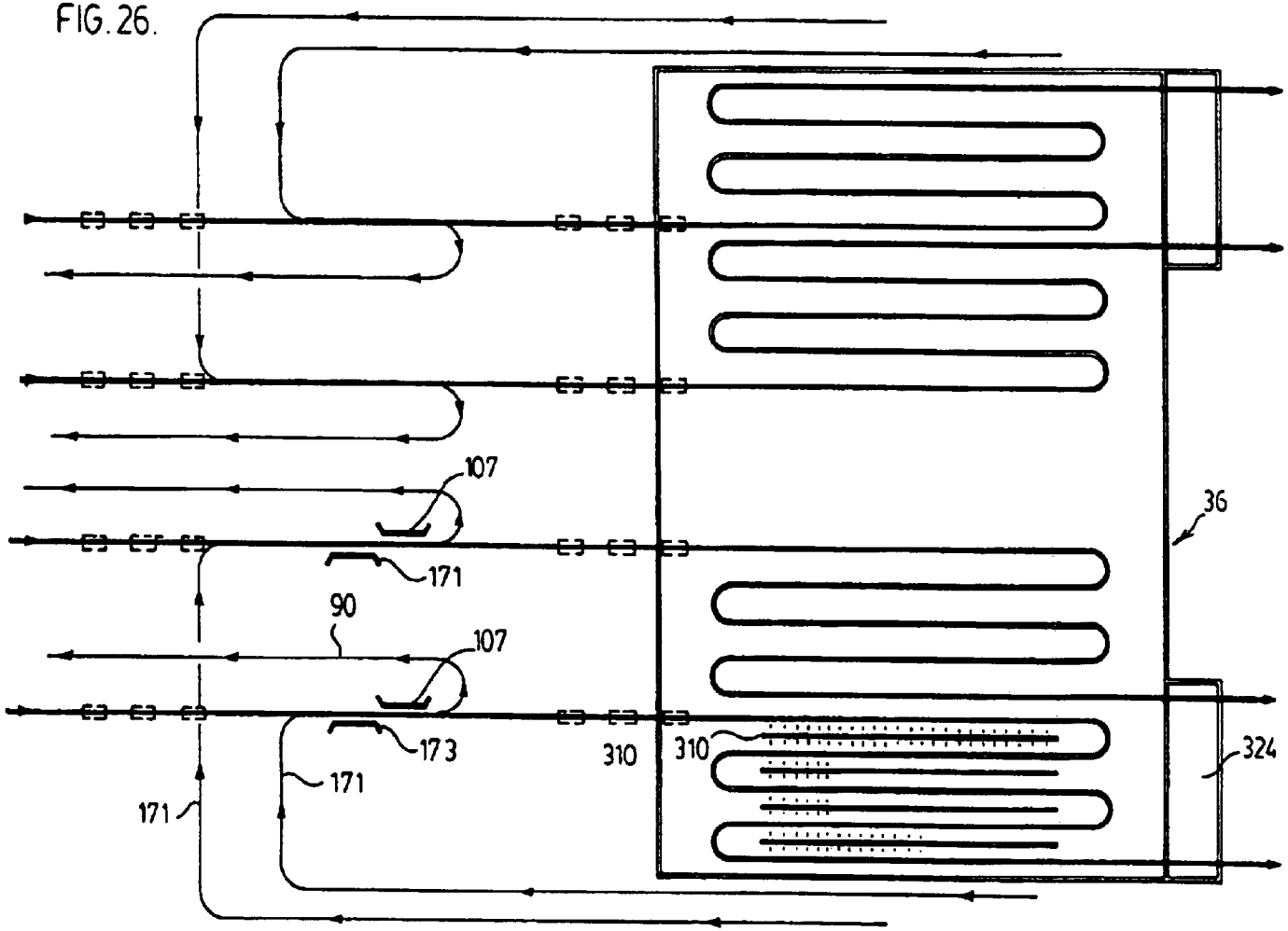
FIG. 26 is a schematic representation of a conveyor transfer station and cooler in-feed.
Figure 30:
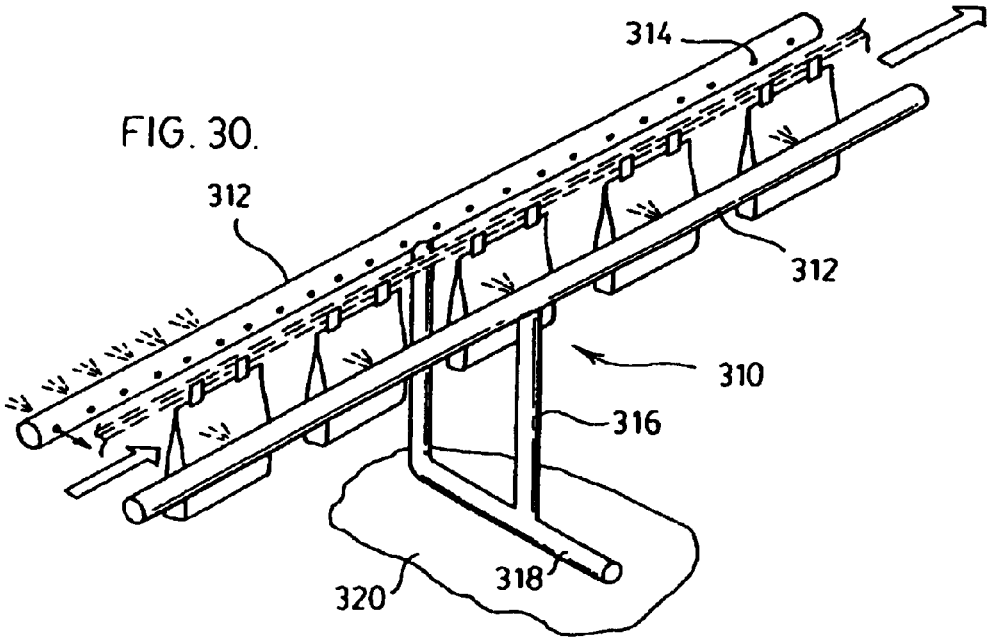
FIG. 30 is a portion of the interior of the cooler.

With the pouches supported by the chain 280, they are moved into a cooler 36 shown in greater detail in FIGS. 26 and 30. The cooler 36 processes the pouches 10 on the four supplementary conveyors 171 in parallel. The pouches 10 remain secured to the conveyor 171 as it is fed through the cooler 36 in a serpentine path. A spray assembly 310 is located between adjacent runs of the conveyor 171 to spray coolant on the pouches 10. The spray assembly 310 includes a manifold 312 that extends longitudinally parallel to the run of the conveyor 171. The manifold 312 includes nozzles 314 at closely spaced intervals along the manifold to provide a continuous spray of coolant along the run of the conveyor. The manifold 312 is supported adjacent the upper edge of the pouches 10 beneath the clip 172 so that the coolant runs over the length of the pouch. The manifold 312 is supplied by a riser 316 connected to a primary coolant line 318. The coolant is collected in a sump 320 for recirculation after further chilling.

After the pouches 10 have passed along the serpentine path defined by the conveyor within the cooler 36, they exit the cooler 36 through a drier 322. The drier is typically an air blast that images on the pouch and removes surplus coolant from the surface of the pouch.

Figure 32:
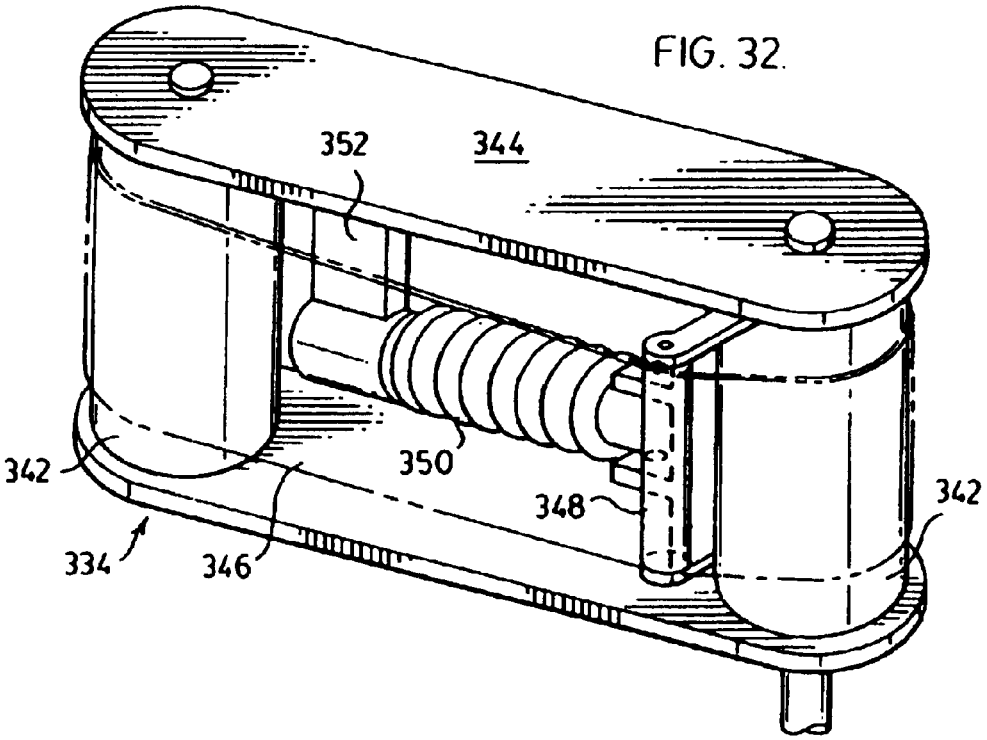
FIG. 32 is a perspective view of a component used in the station of FIG. 31.
Figure 31:
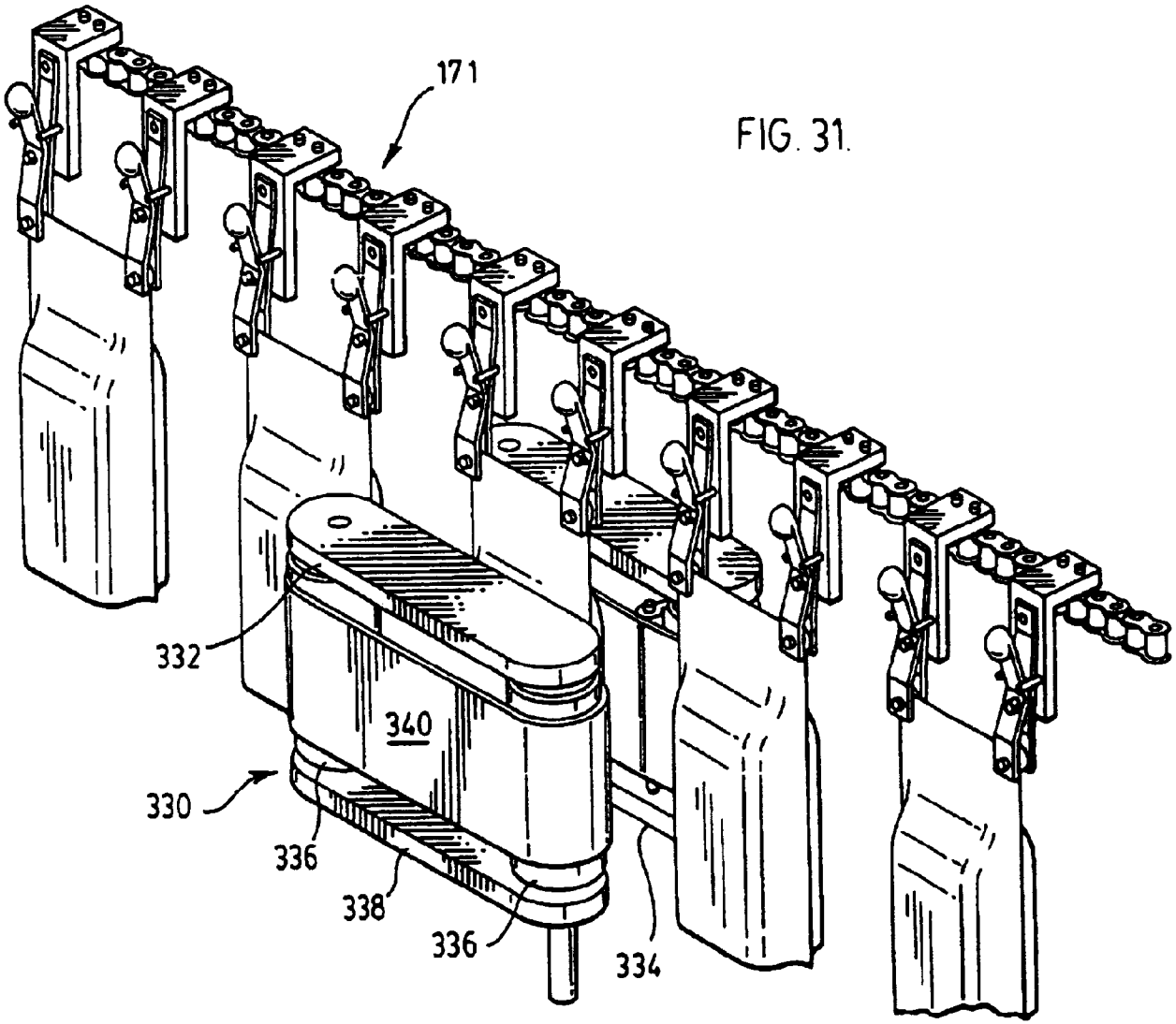
FIG. 31 is a perspective view of an integrity checking station used in the system shown in FIG. 3.

Following cooling, the pouches 10 may be packaged. However, to ensure the integrity of the pouches prior to packaging, a pressure tester 330 is incorporated into the line whilst the pouches 10 are supported on the conveyor 171. The pressure tester is shown in FIG. 31 and 32 and includes an anvil 332 and load cell 334. The pouch 10 passes between the anvil and load cell, which measures the pressure which may be applied to the pouch 10 and thereby indicates the integrity of the pouch. The anvil 322 includes a pair of spaced rollers 336 mounted within a frame 338. A belt 340 extends around the rollers 336 and a drive is provided to one of the rollers 336 to move the belt at the same linear speed as the conveyor 171.

The load cell 334 (FIG. 32) is similarly provided with a pair of rollers 342 maintained in spaced relationship by a frame 344. A belt 346 extends around the rollers, one of which is driven to move the belt 346 at the same linear speed as the conveyor. A sensing roller 348 is supported between the rollers 342 on a cantilevered arm 350. The arm 350 is secured to the frame 344 by a bracket 352. A strain gauge or a similar load sensing device is incorporated into the arm 350 to sense the bending moment applied by the roller 348 to the arm 350. The roller 348 engages the inner surface of the belt 346 and acts through the arm 350 and bracket 352 to resist deflection of the belt 346. As the pouch 10 passes between the belts 340, 346, which are positioned so as to attempt to compress the pouch 10 and its contents, the load exerted on the belt 346 is sensed by the roller 348 and monitored by the strain gauges. If the load exceeds a threshold, the integrity of the pouch is assumed; otherwise the pouch is flagged for removal and further inspection. The pouches are then delivered to a packing station where the clips 172 are released and the conveyor 171 returned to the entrance to the cooler/dryer 36.

As will be appreciated from the above description, the control 42 operates to ensure that the conveyors 28, 90, and 171 function in synchronism and provide a continuous flow of pouches through the system 18. It does this through the use of linear servo drives that provide feedback to the controller 42 so that drive signals can be adjusted. The controller 42 similarly receives signals from the visions systems to ensure an orderly supply of pouches 10 and controls the operation of the filling sealing station 30 to dispense the required contents.

The controller 42 will also ensure the shuttle movement of the filler nozzles and sealing plates is accomplished by utilising linear servo drives to obtain the requisite movement, and, where a fitment is inserted, ensure the drives in the fitment insertion station for transfer mechanism 256 and placement belt 258 are maintained in synchronism with the conveyor 91. The integration of the controls utilises conventional linear servo technology, Such as that available from Allen Bradley, and need not be described further.

It will be noted that at all times the pouch is controlled and moved in synchronism through the various stations of the filling and sealing unit.

Although the invention has been described with reference to certain specific embodiments, various modifications thereof will be apparent to those skilled in the art without departing from the spirit and scope of the invention as outlined in the claims appended hereto.

The embodiments of the invention in which an exclusive property or privilege is claimed are defined as follows:

1. A method of filling a flexible pouch having a base and sidewalls extending from said base to define a mouth, said method comprising delivering said pouches to an infeed conveyor in a predetermined orientation, transporting said pouches in a controlled manner by said infeed conveyor toward a filler station, transferring said pouches from said infeed conveyor to a transport conveyor in which said pouch is gripped adjacent to said mouth so as to be suspended from said transport conveyor, opening said mouth of said pouch to permit filling at said filling station, passing said pouches through said filler station, closing said mouth and sealing said mouth prior to release from said transport conveyor;

wherein movement of said transport conveyor is continuous, wherein a discharge conveyor receives pouches from a pouch maker and delivers said pouches to said infeed conveyor, wherein said pouches are aligned on said discharge conveyor in a preferred orientation, and wherein said pouches are received in containers on said discharge conveyor and biased to said preferred orientation.

2. A method according to claim 1 wherein a vision system detects misalignment of said pouches on said discharge conveyor and a robotic arm adjusts said pouch to said preferred orientation.

3. A method according to claim 1 wherein said pouches are transferred from said discharge conveyor to said infeed conveyor by a robotic device.

4. A method according to claim 3 wherein said discharge conveyor includes a collection zone at which pouches accumulate and said robotic device transfers pouches from said collection zone to said infeed conveyor.

5. A method according to claim 3 wherein said robotic device is adjustable relative to said discharge conveyor in the direction of movement of said discharge conveyor.

6. A method according to claim 5 wherein said robotic device is adjustable transversely to the direction of movement of said discharge conveyor.

7. A method according to claim 3 wherein a pair of discharge conveyors supply pouches to said infeed conveyor and said robotic device selects pouches from either of said discharge conveyors on an intermittent basis.

8. A method according to claim 7 wherein each of said discharge conveyors includes a collection zone to accumulate pouches for selection by said robotic device.

9. A method according to claim 8 including monitoring the pouches at said collection zone and determining which of said zones is to have pouches selected by said robotic device.

10. A method according to claim 9 wherein monitoring is performed by a vision system.

11. A method of filling a flexible pouch having a base and sidewalls extending from said base to define a mouth, said method comprising delivering said pouches to an infeed conveyor in a predetermined orientation, transporting said pouches in a controlled manner by said infeed conveyor toward a filler station, transferring said pouches from said infeed conveyor to a transport conveyor in which said pouch is gripped adjacent to said mouth so as to be suspended from said transport conveyor, opening said mouth of said pouch to permit filling at said filling station, passing said pouches through said filler station, closing said mouth and sealing said mouth prior to release from said transport conveyor;

wherein movement of said transport conveyor is continuous, wherein a discharge conveyor receives pouches from a pouch maker and delivers said pouches to said infeed conveyor, wherein said pouches are transferred from said discharge conveyor to said infeed conveyor by a robotic device, and wherein said robotic device deposits said pouches in buckets carried by said infeed conveyor.

12. A method according to claim 11 wherein said buckets bias said pouches to said predetermined orientation.

13. A method of filling a flexible pouch having a base and sidewalls extending from said base to define a mouth, said method comprising delivering said pouches to an infeed conveyor in a predetermined orientation, transporting said pouches in a controlled manner by said infeed conveyor toward a filler station, transferring said pouches from said infeed conveyor to a transport conveyor in which said pouch is gripped adjacent to said mouth so as to be suspended from said transport conveyor, opening said mouth of said pouch to permit filling at said filling station, passing said pouches through said filler station, closing said mouth and sealing said mouth prior to release from said transport conveyor;

wherein movement of said transport conveyor is continuous, wherein a discharge conveyor receives pouches from a pouch maker and delivers said pouches to said infeed conveyor, wherein said pouches are transferred from said discharge conveyor to said infeed conveyor by a robotic device, and wherein said pouches are arranged on said discharge conveyor in pairs side by side with said mouths oppositely directed and said robotic device rotates at least one of said pouches during transfer to said infeed conveyor to direct said mouths in the same direction.

14. A method according to claim 13 wherein said pouches are supported generally horizontally on said discharge conveyor and said robotic device staggers pairs of pouches in a vertical direction during transfer to said infeed conveyor to facilitate rotation thereof.

15. A method of filling a flexible pouch having a base and sidewalls extending from said base to define a mouth, said method comprising delivering said pouches to an infeed conveyor in a predetermined orientation, transporting said pouches in a controlled manner by said infeed conveyor toward a filler station, transferring said pouches from said infeed conveyor to a transport conveyor in which said pouch is gripped adjacent to said mouth so as to be suspended from said transport conveyor, opening said mouth of said pouch to permit filling at said filling station, passing said pouches through said filler station, closing said mouth and sealing said mouth prior to release from said transport conveyor, wherein movement of said transport conveyor is continuous, and including moving said pouches from a horizontal disposition on said infeed conveyor to a vertical disposition for engagement by said transport conveyor.

16. A method according to claim 15 including the step of rotating said pouch about a generally horizontal axis and elevating said pouch into a position for engagement by said transport conveyor.

17. A pouch filling system for filling a flexible pouch having a base and sidewalls extending from said base to define a mouth, said system including an infeed conveyor having a plurality of containers to maintain said pouches in a predetermined orientation of said infeed conveyor, a filler station to dispense contents into said pouch, a transport conveyor to move said pouch through said filler station, said transport conveyor including a plurality of retainers moveable with said conveyor to grip said pouch adjacent to said mouth so as to be suspended therefrom, and a sealer unit to seal said mouth after said contents are dispensed by said filler whilst gripped by said retainers, where said transport conveyor includes a drive to move said pouches in a continuous manner through said filler, further comprising a discharge conveyor to carry pouches from a pouch maker to said infeed conveyor, and further comprising a plurality of containers on said discharge conveyor, each of said containers receiving a pouch and biasing said pouch to said preferred orientation.

18. A system according to claim 17 wherein said containers have an inclined base to bias said pouches to a preferred position.

19. A system according to claim 17 wherein said discharge conveyor has pairs of containers arranged side by side and said containers bias said pouches to abut a common partition.

20. A system according to claim 17 including a robotic device to transfer said pouches from said discharge conveyor to said infeed conveyor.

21. A system according to claim 20 wherein said robotic device has a plurality of heads to transfer corresponding plurality of pouches from said discharge conveyor to said infeed conveyor.

22. A system according to claim 21 wherein said robotic device is adjustable relative to said discharge conveyor in a direction parallel to the direction of movement of said pouches and said discharge conveyor.

23. A system according to claim 21 wherein said robotic device is adjustable relative to said discharge conveyor in a direction transverse to the direction of movement of said pouches on said discharge conveyor.

24. A system according to claim 21 wherein selected ones of said heads is operable to rotate said pouch during movement between said discharge conveyor and said infeed conveyor.

25. A system according to claim 24 wherein said heads are relatively adjustable in a vertical direction to facilitate rotation of said pouches.

26. A system according to claim 20 including a pair of discharge conveyors, said robotic device being operable to select pouches intermittently from either of said discharge conveyors.

27. A system according to claim 26 wherein each of said conveyors includes a collection zone to accumulate pouches.

28. A system according to claim 27 wherein said collection zones are located at a position to be accessible by said robotic device.

29. A pouch filling system for filling a flexible pouch having a base and sidewalls extending from said base to define a mouth, said system including an infeed conveyor having a plurality of containers to maintain said pouches in a predetermined orientation of said infeed conveyor, a filler station to dispense contents into said pouch, a transport conveyor to move said pouch through said filler station, said transport conveyor including a plurality of retainers moveable with said conveyor to grip said pouch adjacent to said mouth so as to be suspended therefrom, and a sealer unit to seal said mouth after said contents are dispensed by said filler whilst gripped by said retainers, wherein said infeed conveyor includes a plurality of lift arms to elevate said pouches from said containers on said infeed conveyor to said retainers on said transport conveyor.

30. A system according to claim 29 wherein said lift arms rotate said pouches from a generally horizontal position to a generally vertical position.

31. A system according to claim 30 wherein said lift arms are extendable to elevate said pouches relative to said retainers.

* * * * *